US009080475B2

(12) United States Patent
Kobayashi et al.

(10) Patent No.: US 9,080,475 B2
(45) Date of Patent: Jul. 14, 2015

(54) VALVE TIMING CONTROL DEVICE AND VALVE TIMING CONTROL MECHANISM

(75) Inventors: Masaki Kobayashi, Okazaki (JP); Kenji Ikeda, Nagoya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 0 days.

(21) Appl. No.: 14/131,102

(22) PCT Filed: Jun. 15, 2012

(86) PCT No.: PCT/JP2012/065337

§ 371 (c)(1),
(2), (4) Date: Jan. 6, 2014

(87) PCT Pub. No.: WO2013/005556

PCT Pub. Date: Jan. 10, 2013

(65) Prior Publication Data

US 2014/0130755 A1 May 15, 2014

(30) Foreign Application Priority Data

Jul. 7, 2011 (JP) ..... 2011-151098

(51) Int. Cl.

| | |
|---|---|
| ***F01L 1/34*** | (2006.01) |
| ***F01L 1/356*** | (2006.01) |
| ***F01L 1/344*** | (2006.01) |

(52) U.S. Cl.

CPC ..... *F01L 1/356* (2013.01); *F01L 1/3442* (2013.01); *F01L 2001/34453* (2013.01);
(Continued)

(58) Field of Classification Search

CPC ..... F01L 1/3442; F01L 1/356; F01L 2001/34466; F01L 2001/34469; F01L 2001/34476; F01L 2001/34483; F01L 2001/34453

USPC ..... 123/90.15, 90.17; 464/160

See application file for complete search history.

(56) References Cited

U.S. PATENT DOCUMENTS

| | | | |
|---|---|---|---|
| 5,823,152 | A | 10/1998 | Ushida |
| 5,836,277 | A | 11/1998 | Kira et al. |

(Continued)

FOREIGN PATENT DOCUMENTS

| | | | |
|---|---|---|---|
| DE | 19918910 | A1 | 4/1999 |
| EP | 1452700 | A1 | 1/2004 |

(Continued)

OTHER PUBLICATIONS

International Preliminary Report on Patentability (Form PCT/IB/373) and Written Opinion of the International Searching Authority and English Translation thereof (Form PCT/ISA/237) issued on Jan. 16, 2014 in the corresponding International Application No. PCT/JP2012/065337 (7 pages).

(Continued)

*Primary Examiner* — Ching Chang

(74) *Attorney, Agent, or Firm* — Buchanan Ingersoll & Rooney PC

(57) ABSTRACT

A valve timing control device is switchable between a first state in which a fluid is supplied to a communication flow path to lift a restriction by a restriction member and release a lock by a lock member, a second state in which the fluid is supplied to a retarded angle chamber to release the lock by the lock member and set the restriction by the restriction member, and a third state in which the restriction member is restricted and the lock member is locked without supplying the fluid to the communication flow path and supplying the fluid to the retarded angle chamber, and is configured such that the minimum cross-sectional area of an advanced passage for supplying the fluid to an advanced chamber is greater than the minimum cross-sectional area of a retarded passage for supplying the fluid to the retarded angle chamber.

10 Claims, 14 Drawing Sheets

(52) U.S. Cl.
CPC ..... *F01L 2001/34466* (2013.01); *F01L 2001/34469* (2013.01); *F01L 2001/34476* (2013.01); *F01L 2001/34483* (2013.01)

(56) References Cited

U.S. PATENT DOCUMENTS

| | | | | |
|---|---|---|---|---|
| 6,053,139 | A | 4/2000 | Eguchi et al. | |
| 6,505,586 | B1 | 1/2003 | Sato et al. | |
| 6,739,298 | B2 | 5/2004 | Kusano et al. | |
| 7,497,193 | B2 | 3/2009 | Knecht et al. | |
| 8,360,022 | B2 | 1/2013 | Ozawa et al. | |
| 2002/0139331 | A1 | 10/2002 | Takahashi et al. | |
| 2002/0139332 | A1 | 10/2002 | Takenaka | |
| 2005/0016481 | A1 | 1/2005 | Komazawa et al. | |
| 2005/0257763 | A1 | 11/2005 | Watanabe et al. | |
| 2007/0144475 | A1 | 6/2007 | Suzuki et al. | |
| 2010/0050966 | A1 | 3/2010 | Ozawa et al. | |
| 2010/0175649 | A1 | 7/2010 | Suzuki et al. | |
| 2010/0294223 | A1 | 11/2010 | Adachi et al. | |
| 2011/0000449 | A1 | 1/2011 | Urushihata et al. | |
| 2011/0061619 | A1 | 3/2011 | Urushihata | |
| 2011/0085921 | A1 | 4/2011 | Kato et al. | |
| 2011/0088645 | A1 | 4/2011 | Yamaguchi et al. | |
| 2011/0168114 | A1 | 7/2011 | Kobayashi et al. | |
| 2012/0000437 | A1* | 1/2012 | Ozawa et al. | 123/90.15 |
| 2013/0112161 | A1 | 5/2013 | Fujiwaki et al. | |
| 2013/0146005 | A1* | 6/2013 | Watanabe | 123/90.15 |
| 2013/0192551 | A1* | 8/2013 | Hayashi | 123/90.17 |
| 2014/0083379 | A1* | 3/2014 | Yoshimura et al. | 123/90.15 |
| 2014/0150741 | A1* | 6/2014 | Hayashi et al. | 123/90.15 |

FOREIGN PATENT DOCUMENTS

| | | | |
|---|---|---|---|
| JP | 11-132015 | A | 5/1999 |
| JP | 11-210424 | A | 8/1999 |
| JP | 11-236831 | A | 8/1999 |
| JP | 11-311107 | A | 11/1999 |
| JP | 2000-002104 | A | 1/2000 |
| JP | 2001-055934 | A | 2/2001 |
| JP | 2002-285872 | A | 10/2002 |
| JP | 2002-357105 | A | 12/2002 |
| JP | 2003-206711 | A | 7/2003 |
| JP | 2003-286813 | A | 10/2003 |
| JP | 2005-330892 | A | 12/2005 |
| JP | 2006-220154 | A | 8/2006 |
| JP | 3918971 | B2 | 5/2007 |
| JP | 2007-198365 | A | 8/2007 |
| JP | 2008-180132 | A | 8/2008 |
| JP | 2009-047128 | A | 3/2009 |
| JP | 2009-074384 | A | 4/2009 |
| JP | 2009-203886 | A | 9/2009 |
| JP | 2009-243372 | A | 10/2009 |
| JP | 2010-065605 | A | 3/2010 |
| JP | 2010-138732 | A | 6/2010 |
| JP | 2010-270740 | A | 12/2010 |
| JP | 2010-285986 | A | 12/2010 |
| JP | 2011-032950 | A | 2/2011 |
| JP | 2011-058444 | A | 3/2011 |
| JP | 2011-069245 | A | 4/2011 |
| JP | 2011-080430 | A | 4/2011 |
| JP | 2011-094533 | A | 5/2011 |
| JP | 2011-111893 | A | 6/2011 |
| WO | WO 2011/001702 | A1 | 1/2011 |
| WO | WO 2011001702 | A1 * | 1/2011 |
| WO | WO 2012/008354 | A1 | 1/2012 |

OTHER PUBLICATIONS

International Search Report (PCT/ISA/210) issued on Mar. 9, 2010, by Japanese Patent Office as the International Searching Authority for International Application No. PCT/JP2010/052075.

Written Opinion (PCT/ISA/237) issued on Mar. 9, 2010, by Japanese Patent Office as the International Searching Authority for International Application No. PCT/JP2010/052075.

Notification of Transmittal of Translation of the International Preliminary Report on Patentability (Forms PCT/IB/338 and PCT/IB/373) and the Written Opinion of the International Searching Authority (Form PCT/ISA/237) issued on Feb. 23, 2012, in the corresponding International Application No. PCT/JP2010/052075 (6 pages).

International Search Report (PCT/ISA/210) issued on Aug. 2, 2011, by the Japanese Patent Office as the International Searching Authority for International Application No. PCT/JP2011/065589.

Written Opinion (PCT/ISA/237) issued on Aug. 2, 2011, by the Japanese Patent Office as the International Searching Authority for International Application No. PCT/JP2011/065589.

International Preliminary Report on Patentability (PCT/IB/338) and English Translation of Written Opinion of the International Searching Authority (PCT/ISA/237( in the corresponding International Patent Application No. PCT/JP2011/065589.

International Search Report (PCT/ISA/210) mailed on Sep. 11, 2012, by the Japanese Patent Office as the International Searching Authority for International Application No. PCT/JP2012/065337.

Written Opinion (PCT/ISA/237) mailed on Sep. 11, 2012, by the Japanese Patent Office as the International Searching Authority for International Application No. PCT/JP2012/065337.

International Search Report (PCT/ISA/210) mailed on Aug. 7, 2012, by the Japanese Patent Office as the International Searching Authority for International Application No. PCT/JP2012/067176.

Written Opinion (PCT/ISA/237) mailed on Aug. 7, 2012, by the Japanese Patent Office as the International Searching Authority for International Application No. PCT/JP2012/067176.

International Search Report (PCT/ISA/210) mailed on Aug. 7, 2012, by the Japanese Patent Office as the International Searching Authority for International Application No. PCT/JP2012/067175.

Written Opinion (PCT/ISA/237) mailed on Aug. 7, 2012, by the Japanese Patent Office as the International Searching Authority for International Application No. PCT/JP2012/067175.

Japanese Office Action for Japanese Patent Application No. 2011-154143. English translation of relevant portion of Notice of Reasons for Rejection, dated Nov. 13, 2013.

European Communication dated Dec. 18, 2014 issued in the corresponding European Patent Application No. 12808041.3-1606 (5 pages).

* cited by examiner

VALVE TIMING CONTROL DEVICE AND VALVE TIMING CONTROL MECHANISM

TECHNICAL FIELD

The present invention relates to valve timing control devices and valve timing control mechanisms that control the relative rotational phase of a driven-side rotating member relative to a driving-side rotating member that rotates in synchronization with a crankshaft in an internal combustion engine.

BACKGROUND ART

A valve timing control device is known that, in addition to a lock mechanism for holding the relative rotational phase of a driven-side rotating member relative to a driving-side rotating member at a predetermined phase (a locked phase), includes a restriction mechanism, configured of a restriction recess formed in the driven-side rotating member and a restriction member that is provided in the driving-side rotating member, that is capable of extending into/retracting from the restriction recess.

For example, the valve timing control device disclosed in PTL 1 includes a restriction mechanism configured of a restriction member 5 and a restriction recess 52. Providing the restriction mechanism makes it possible to operate the lock mechanism after the relative rotational phase of the driven-side rotating member relative to the driving-side rotating member has been restricted to a set range, which has an advantage in that it is easier to achieve a locked state.

CITATION LIST

Patent Literature

PTL 1: International Publication WO 2011/001702

SUMMARY OF INVENTION

Technical Problem

However, for the restriction mechanism in such a valve timing control device to function properly, it is necessary to rapidly execute an insertion operation for inserting the restriction member 5 into the restriction recess 52. If the operation for inserting the restriction member 5 is not executed rapidly, the relative rotational phase of the driven-side rotating member relative to the driving-side rotating member cannot be restricted to the set range, and as a result, the locked state cannot be rapidly achieved. Accordingly, there is a risk that the engine will stop without the valve timing control device able to enter the locked state, which may interfere with the next engine startup.

Having been achieved in light of the aforementioned situation, it is an object of the present invention to provide a configuration enabling a restricted state to be rapidly achieved in a valve timing control device or a valve timing control mechanism provided with a restriction mechanism.

Solution to Problem

A characteristic configuration of a valve timing control device according to the present invention includes: a driving-side rotating member that rotates in synchronization with a crankshaft of an internal combustion engine; a driven-side rotating member, disposed coaxially with the driving-side rotating member, that rotates in synchronization with a cam shaft for opening and closing a valve of the internal combustion engine; a fluid pressure chamber formed by the driving-side rotating member and the driven-side rotating member; a partition portion provided in at least one of the driving-side rotating member and the driven-side rotating member so as to partition the fluid pressure chamber into an advanced angle chamber and a retarded angle chamber; a restriction member that is disposed in one of the driving-side rotating member and the driven-side rotating member and that is capable of extending/retracting into/from the other of the rotating members; a restriction recess, formed in the other of the rotating members, into which the restriction member is inserted and that restricts a relative rotational phase of the driven-side rotating member relative to the driving-side rotating member to a range from one of a maximum advanced phase and a maximum retarded phase to a predetermined phase between the maximum advanced phase and the maximum retarded phase; a lock member that is disposed in the one rotating member in which the restriction member is provided and that is capable of extending/retracting into/from the other of the rotating members; a locking recess, formed in the other of the rotating members, into which the lock member is inserted and that locks the relative rotational phase of the driven-side rotating member relative to the driving-side rotating member in the predetermined phase; and a communication flow path formed between the restriction member and the lock member. Here, the device can switch between a first state in which a fluid is supplied to the communication flow path, the restriction by the restriction member is lifted, and the locking by the lock member is released, a second state in which the fluid is supplied to one of the advanced angle chamber and the retarded angle chamber, the locking by the lock member is released, and the restriction member sets the restriction, and a third state in which the fluid is not supplied to the communication flow path and is not supplied to the one of the advanced angle chamber and the retarded angle chamber, the restriction member sets the restriction, and the lock member carries out locking; and a minimum cross-sectional area of a flow path that supplies the fluid to the other of the advanced angle chamber and the retarded angle chamber is configured to be greater than a minimum cross-sectional area of a flow path that supplies the fluid to the one of the advanced angle chamber and the retarded angle chamber.

According to this configuration, the first state in which both the restricted state created by the restriction member and the locked state created by the lock member are released, the second state in which only the locked state created by the lock member is released, and the third state in which locking is carried out by the lock member can be achieved by switching between supplying/discharging the fluid to/from the advanced angle chamber and the retarded angle chamber and switching between supplying/discharging the fluid to/from the communication flow path. Accordingly, the locked state can be achieved before the engine stops, and the engine can start up smoothly the next time the engine is started. Furthermore, even if the locked state has failed to be achieved, the configuration is such that the respective states are transited to as a result of the fluid supply/discharge control, and thus the locked state can be achieved again while the engine is running.

According to this configuration, when transiting to the second state, it is necessary to supply the fluid to one of the advanced angle chamber and the retarded angle chamber. In other words, in order to smoothly transit to the restricted state, it is preferable for the fluid to be rapidly discharged from the other of the advanced angle chamber and the retarded angle chamber. Accordingly, in this configuration, the minimum cross-sectional area of the flow path that supplies the fluid to the other of the advanced angle chamber and the retarded angle chamber is set to be greater than the minimum cross-sectional area of the flow path that supplies the fluid to the one of the advanced angle chamber and the retarded angle chamber. As a result, it is easier to discharge the fluid from the other of the advanced angle chamber and the retarded angle chamber, which makes it possible to rapidly achieve the restricted state.

A characteristic configuration of a valve timing control mechanism according to the present invention includes: a driving-side rotating member that rotates in synchronization with a crankshaft of an internal combustion engine; a driven-side rotating member, disposed coaxially with the driving-side rotating member, that rotates in synchronization with a cam shaft for opening and closing a valve of the internal combustion engine; a fluid pressure chamber formed by the driving-side rotating member and the driven-side rotating member; a partition portion provided in at least one of the driving-side rotating member and the driven-side rotating member so as to partition the fluid pressure chamber into an advanced angle chamber and a retarded angle chamber; a restriction member that is disposed in one of the driving-side rotating member and the driven-side rotating member and that is capable of extending/retracting into/from the other of the rotating members; a restriction recess, formed in the other of the rotating members, into which the restriction member is inserted and that restricts a relative rotational phase of the driven-side rotating member relative to the driving-side rotating member to a range from one of a maximum advanced phase and a maximum retarded phase to a predetermined phase between the maximum advanced phase and the maximum retarded phase; a lock member that is disposed in the one rotating member in which the restriction member is provided and that is capable of extending/retracting into/from the other of the rotating members; a locking recess, formed in the other of the rotating members, into which the lock member is inserted and that locks the relative rotational phase of the driven-side rotating member relative to the driving-side rotating member in the predetermined phase; a communication flow path formed between the restriction member and the lock member; and an advanced/retarded control valve that switches a supply of fluid to one of the advanced angle chamber and the retarded angle chamber. Here, the mechanism can switch between a first state in which a fluid is supplied to the communication flow path, the restriction by the restriction member is lifted, and the locking by the lock member is released, a second state in which the fluid is supplied to one of the advanced angle chamber and the retarded angle chamber, the locking by the lock member is released, and the restriction member sets the restriction, and a third state in which the fluid is not supplied to the communication flow path and is not supplied to the one of the advanced angle chamber and the retarded angle chamber, the restriction member sets the restriction, and the lock member carries out locking; and a minimum cross-sectional area of a flow path between the advanced/retarded control valve and the other of the advanced angle chamber and the retarded angle chamber is configured to be greater than a minimum cross-sectional area of a flow path between the advanced/retarded control valve and the one of the advanced angle chamber and the retarded angle chamber.

According to this configuration, the first state in which both the restricted state created by the restriction member and the locked state created by the lock member are released, the second state in which only the locked state created by the lock member is released, and the third state in which locking is carried out by the lock member can be achieved by switching between supplying/discharging the fluid to/from the advanced angle chamber and the retarded angle chamber and switching between supplying/discharging the fluid to/from the communication flow path. Accordingly, the locked state can be achieved before the engine stops, and the engine can start up smoothly the next time the engine is started. Furthermore, even if the locked state has failed to be achieved, the configuration is such that the respective states are transited to as a result of the fluid supply/discharge control, and thus the locked state can be achieved again while the engine is running.

According to this configuration, when transiting to the second state, it is necessary to supply the fluid to one of the advanced angle chamber and the retarded angle chamber. In other words, in order to smoothly transit to the restricted state, it is preferable for the fluid to be rapidly discharged from the other of the advanced angle chamber and the retarded angle chamber. Accordingly, in this configuration, the minimum cross-sectional area of the flow path between the advanced/retarded control valve that switches a supply of fluid to one of the advanced angle chamber and the retarded angle chamber and the other of the advanced angle chamber and the retarded angle chamber is configured to be greater than a minimum cross-sectional area of the flow path between the advanced/retarded control valve and the one of the advanced angle chamber and the retarded angle chamber. As a result, it is easier to discharge the fluid from the other of the advanced angle chamber and the retarded angle chamber, which makes it possible to rapidly achieve the restricted state.

A further characteristic configuration of the valve timing control device or the valve timing control mechanism according to the present invention is that the fluid is supplied to the communication flow path by communicating with the other of the advanced angle chamber and the retarded angle chamber.

According to this configuration, the supply/discharge of the fluid to/from the communication flow path occurs in tandem with the supply/discharge of the fluid to/from the advanced angle chamber and the retarded angle chamber. Accordingly, a dedicated valve for switching the supply/discharge of the fluid to/from the communication flow path is unnecessary, which provides an advantage in terms of cost and installation.

A further characteristic configuration of the valve timing control device or the valve timing control mechanism according to the present invention is that a plurality of the partition portions are provided in the driven-side rotating member, and the lock member and the restriction member are both provided in one of the plurality of the partition portions.

According to this configuration, the lock member and the restriction member are provided in one of the partition portions, and thus the communication flow path can be formed in one of the partition portions, making it possible to simplify the configuration.

A further characteristic configuration of the valve timing control device or the valve timing control mechanism according to the present invention is that a drain flow path that communicates with the exterior of the driving-side rotating member is provided in at least the rotating member in which, of the driving-side rotating member and the driven-side rotating member, the restriction member is provided, and the drain flow path communicates with the restriction recess.

According to this configuration, the fluid within the restriction recess can be quickly discharged to the exterior through the drain flow path, which makes it possible for the restriction member to extend and retract rapidly.

A further characteristic configuration of the valve timing control device or the valve timing control mechanism according to the present invention is that when the relative rotational phase is within one of a phase range that excludes a range from the maximum advanced phase including the maximum advanced phase to the predetermined phase and a phase range that excludes a range from the maximum retarded phase including the maximum retarded phase to the predetermined phase, and the relative rotational phase is within a phase range where the restriction member can extend/retract from/into the restriction recess, the drain flow path is blocked from communicating with the exterior of the driving-side rotating member.

According to this configuration, when the fluid is supplied from the advanced angle chamber or the retarded angle chamber to the restriction recess, the restriction carried out by the restriction member can be rapidly lifted if the drain flow path is blocked.

DESCRIPTION OF EMBODIMENTS

Figure 1:
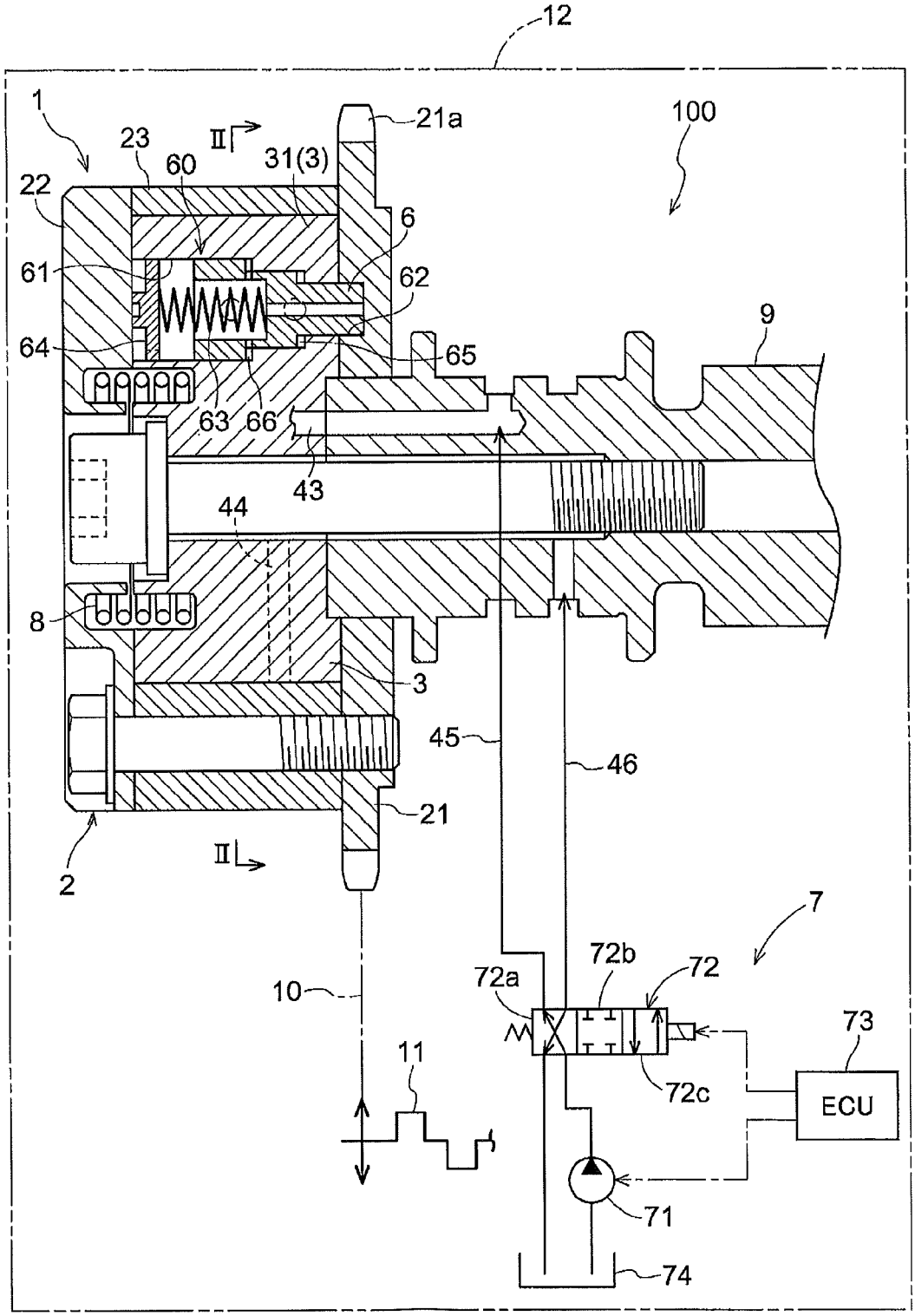
FIG. 1 is a cross-sectional view illustrating the overall configuration of a valve timing control device, seen from the side.

Embodiments of the present invention will be described based on FIGS. 1 to 14. First, the overall configuration of a valve timing control device 1 will be described based on FIGS. 1 and 2.

(Overall Configuration)

The valve timing control device 1 includes an outer rotor 2 serving as a driving-side rotating member that rotates in synchronization with a crankshaft 11 of an engine 12 such as an internal combustion engine, and an inner rotor 3 serving as a driven-side rotating member that is disposed coaxially with the outer rotor 2 and that rotates in synchronization with a cam shaft 9.

The outer rotor 2 is configured of a rear plate 21 attached on a side to which the cam shaft 9 is connected, a front plate 22 attached on the opposite side as the side to which the cam shaft 9 is connected, and a housing 23 sandwiched between the rear plate 21 and the front plate 22. The inner rotor 3 housed within the outer rotor 2 is assembled integrally with a leading end portion of the cam shaft 9, and is capable of rotating relative to the outer rotor 2 within a set range.

Figure 2:
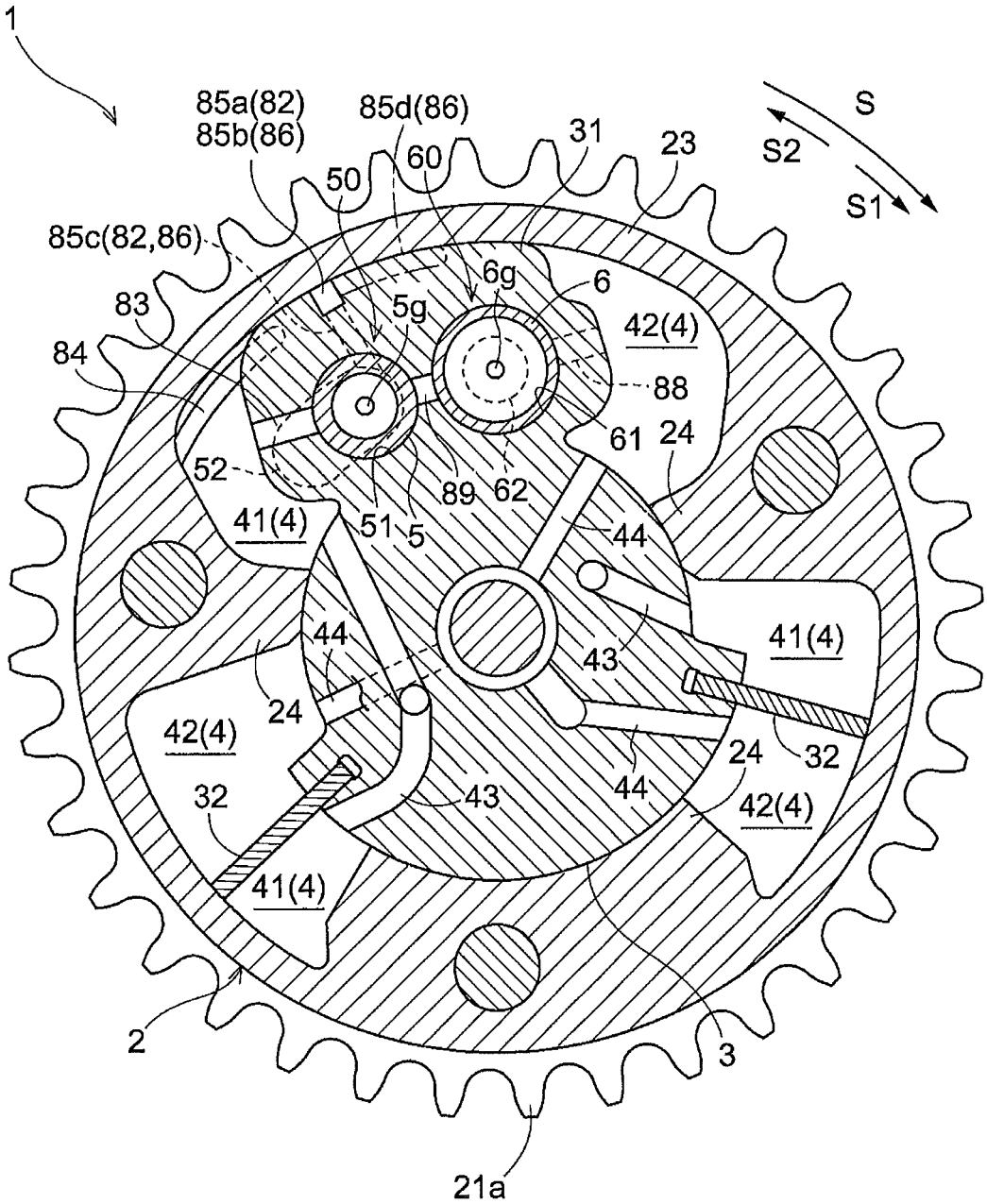
FIG. 2 is a cross-sectional view taken along the II-II line shown in FIG. 1.

When the crankshaft 11 is rotationally driven, a resulting rotational driving force is transmitted to a sprocket portion 21*a* in the rear plate 21 via a power transmission member 10, and the outer rotor 2 is rotationally driven in a direction indicated by S in FIG. 2. The inner rotor 3 is rotationally driven in the S direction in response to the outer rotor 2 being rotationally driven, and the cam shaft 9 rotates as a result.

A plurality of projecting portions 24 that project in an inner radial direction are formed in the housing 23 of the outer rotor 2 so as to be spaced relative to each other along the S direction. Fluid pressure chambers 4 are formed by the projecting portions 24 and the inner rotor 3. Although the fluid pressure chambers 4 are provided in three locations in the present embodiment, the invention is not limited thereto.

Each of the fluid pressure chambers 4 is divided into an advanced angle chamber 41 and a retarded angle chamber 42 by a partition portion 31 that forms part of the inner rotor 3 or vanes 32 attached to the inner rotor 3. The restriction member 5 and a lock member 6 are housed in a restriction member housing portion 51 and a lock member housing portion 61, respectively, that are formed in the partition portion 31, and a restriction mechanism 50 and a lock mechanism 60 are respectively configured of those corresponding elements. The configurations thereof will be described later.

An advanced passage 43 formed in the inner rotor 3 communicates with the advanced angle chamber 41. Likewise, a retarded passage 44 formed in the inner rotor 3 communicates with the retarded angle chamber 42. An advanced connection path 45 connected to the advanced passage 43 and a retarded connection path 46 connected to the retarded passage 44 are formed between the valve timing control device 1 and a fluid supply/discharge mechanism 7. The advanced connection path 45 and the retarded connection path 46 are formed in a cylinder head or the like (not shown) in which the cam shaft 9, the fluid supply/discharge mechanism 7, and so on are provided. Here, a mechanism that includes the valve timing control device 1 and the fluid supply/discharge mechanism 7 will be referred to as a valve timing control mechanism 100.

The advanced passage 43 and the retarded passage 44 supply and discharge a fluid to and from the advanced angle chamber 41 and the retarded angle chamber 42, respectively, via an advanced/retarded control valve 72 in the fluid supply/discharge mechanism 7, causing a fluid pressure to act on the partition portion 31 or the vanes 32. In this manner, the relative rotational phase of the inner rotor 3 relative to the outer rotor 2 (called simply a "relative rotational phase" hereinafter) is changed to an advanced direction S1 or a retarded direction S2 shown in FIG. 2, or is held at a given phase. Note that engine oil is typically used as the fluid.

The set range in which the outer rotor 2 and the inner rotor 3 can rotate relative to each other corresponds to a range over which the partition portion 31 or the vanes 32 can displace within the fluid pressure chambers 4. A maximum volume of the advanced angle chamber 41 corresponds to a maximum advanced phase, and a maximum volume of the retarded angle chamber 42 corresponds to a maximum retarded phase. In other words, the relative rotational phase can change between a maximum advanced phase and a maximum retarded phase.

A torsion spring 8 is provided spanning across the inner rotor 3 and the front plate 22. The inner rotor 3 and the outer rotor 2 are biased by the torsion spring 8 so that the relative rotational phase changes to the advanced direction S1.

Next, the configuration of the fluid supply/discharge mechanism 7 will be described. The fluid supply/discharge mechanism 7 includes a pump 71 that is driven by the engine 12 and supplies the fluid, the advanced/retarded control valve 72 that controls the supply and discharge of the fluid to and from the advanced passage 43 and the retarded passage 44, and a reservoir portion 74 that holds the fluid.

The advanced/retarded control valve 72 operates under the control of an ECU 73 (an engine control unit). The advanced/retarded control valve 72 has a first position 72*a* at which advancement control is carried out by permitting the fluid to be supplied to the advanced passage 43 and permitting the fluid to be discharged from the retarded passage 44, a second position 72*b* at which phase holding control is carried out by prohibiting the fluid from being supplied to/discharged from the advanced passage 43 and the retarded passage 44, and a third position 72*c* at which retardation control is carried out by permitting the fluid to be discharged from the advanced passage 43 and permitting the fluid to be supplied to the retarded passage 44. The advanced/retarded control valve 72 according to the present embodiment is configured to carry out advancement control at the first position 72*a* in a state where there is no control signal from the ECU 73.

(Restriction Mechanism)

Figure 3:
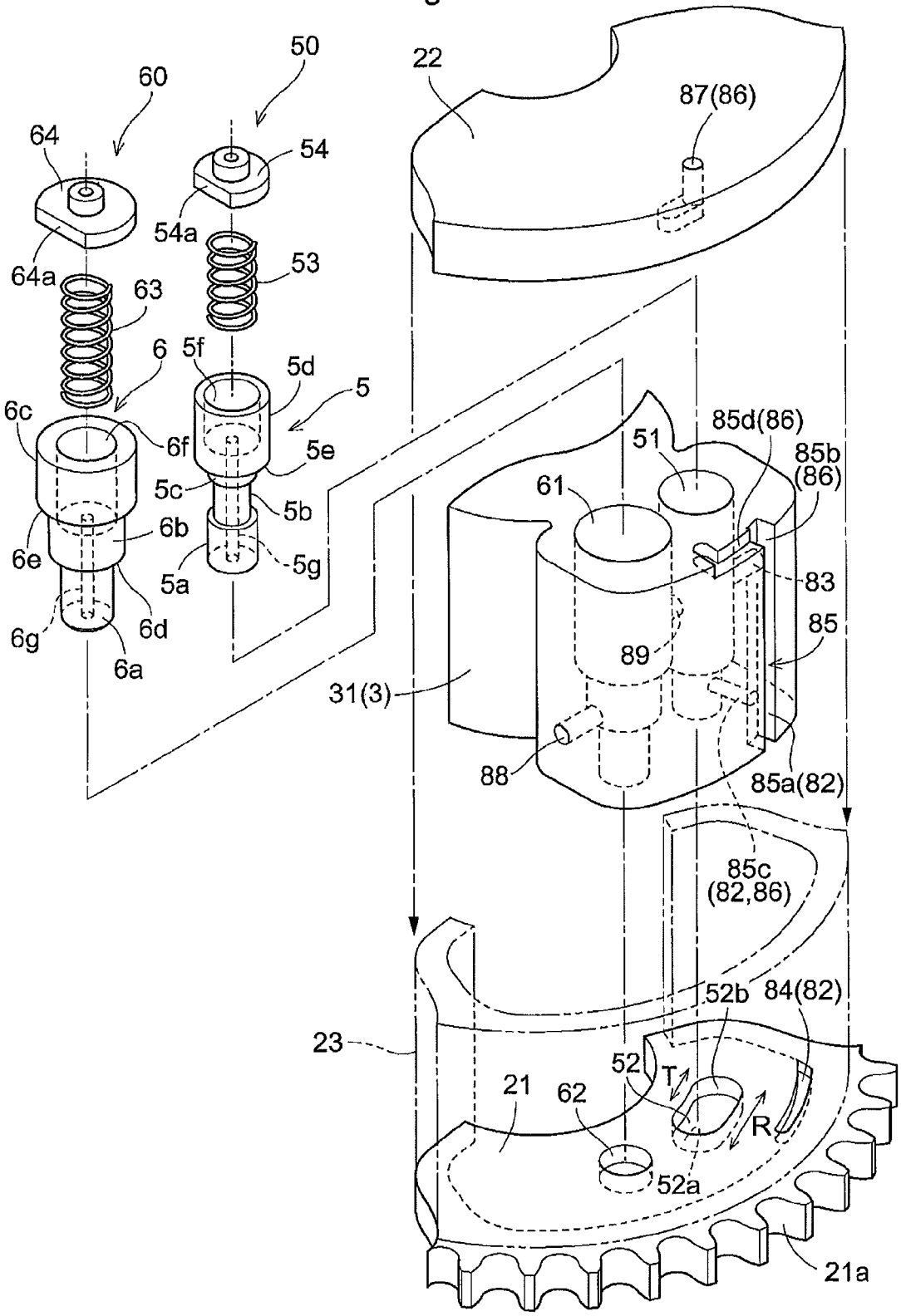
FIG. 3 is an exploded view illustrating the configuration of a restriction mechanism and a lock mechanism.
Figure 4:
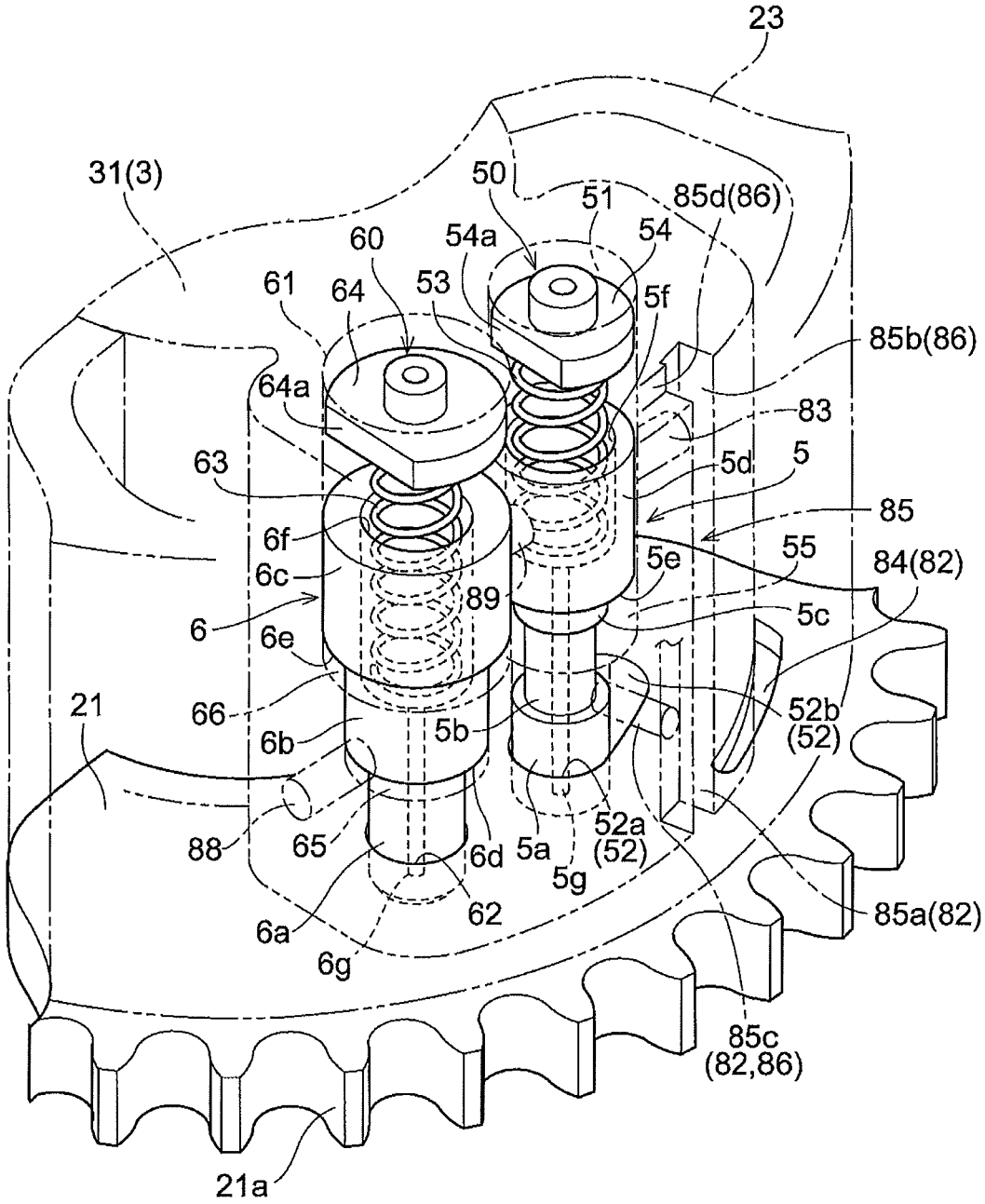
FIG. 4 is a perspective view illustrating the configuration of the restriction mechanism and the lock mechanism.

The configuration of the restriction mechanism 50, which restricts the relative rotational phase to a range (called a "restriction range R" hereinafter) from the maximum retarded phase to an intermediate locked phase (a "predetermined phase" according to the present invention) will be described based on FIG. 3 and FIG. 4. The intermediate locked phase refers to the relative rotational phase when locked by the lock mechanism 60, which will be mentioned later.

The restriction mechanism 50 is primarily configured of the stepped, cylindrical restriction member 5, the restriction member housing portion 51 that is formed in the partition portion 31 of the inner rotor 3 and that houses the restriction member 5, and the restriction recess 52 having a long-hole shape formed in a surface of the rear plate 21 so that the restriction member 5 can be inserted thereinto.

The restriction member 5 has a shape in which, for example, four cylinders of different diameters are stacked so as to form four steps. These cylinders forming four steps will be referred to as a first step portion 5*a*, a second step portion 5*b*, a third step portion 5*c*, and a fourth step portion 5*d*, in that order from the side where the rear plate 21 is located. The second step portion 5*b* is configured having a lower diameter than the first step portion 5*a*, and the second step portion 5*b*, the third step portion 5*c*, and the fourth step portion 5*d* are configured so that the diameters thereof increase in that order from the side on which the front plate 22 is located. Note that the third step portion 5*c* is provided to reduce the volume of a first fluid chamber 55, which will be mentioned later, and to improve the operability of the restriction member 5 when the fluid is supplied to the first fluid chamber 55.

The first step portion 5*a* is formed so as to be capable of being inserted into the restriction recess 52, and the relative rotational phase is restricted within the restriction range R when the first step portion 5*a* is inserted into the restriction recess 52. A cylindrical recess portion 5*f* is formed in the fourth step portion 5*d*, and a spring 53 is contained therein. In addition, a through-hole 5*g* is formed in a central area of the restriction member 5 in order to reduce the resistance of the fluid when the restriction member 5 moves in the direction of the bias and accordingly improve the operability.

A plug member 54 is provided between the restriction member 5 and the front plate 22, and the spring 53 is disposed between the plug member 54 and a bottom surface of the recess portion 5*f*. A cutout portion 54*a* formed in the plug member 54 makes it possible to discharge the fluid outside of the valve timing control device 1 through a discharge flow path, which is not shown, when the restriction member 5 moves toward the front plate 22, and contributes to the operability of the restriction member 5.

The restriction member housing portion 51 is formed in the partition portion 31 of the inner rotor 3 along a direction of the rotational core of the cam shaft 9 (called simply a "rotational core" hereinafter), and passes through the partition portion 31 from the side on which the front plate 22 is located to the side on which the rear plate 21 is located. The restriction member housing portion 51 is formed having a shape in which, for example, two cylindrical spaces of different diameters are stacked so as to form two steps, so that the restriction member 5 can move within the inner space thereof.

The restriction recess 52 is formed having a rounded arc shape centered on the rotational core, and is formed so that a position in the radial direction thereof is slightly different from that of a locking recess 62, which will be mentioned later. The restriction recess 52 is configured so that the relative rotational phase is the intermediate locked phase when the restriction member 5 is in contact with a first end portion 52*a* of the restriction recess 52 and so that the relative rotational phase is the maximum retarded phase when the restriction member 5 is in contact with a second end portion 52*b* of the restriction recess 52. In other words, the restriction recess 52 corresponds to the restriction range R.

The restriction member 5 is housed within the restriction member housing portion 51 and is continually biased toward the rear plate 21 by the spring 53. When the first step portion 5*a* of the restriction member 5 is inserted into the restriction recess 52, the relative rotational phase is restricted to the range of the restriction range R, thus achieving a "restricted state". When the first step portion 5*a* retracts from the restriction recess 52 against the biasing force of the spring 53, the restricted state is lifted, thus achieving a "restriction lifted state".

When the restriction member 5 is housed within the restriction member housing portion 51, the cyclic first fluid chamber 55 is formed between an outer circumferential surface of the restriction member 5 and an inner circumferential surface of the restriction member housing portion 51. When the fluid is supplied to the first fluid chamber 55 and the fluid pressure acts on a first pressure receiving surface 5*e*, the restriction member 5 moves toward the front plate 22 against the biasing force of the spring 53, resulting in the restriction lifted state. A configuration of a flow path for supplying/discharging the fluid to/from the first fluid chamber 55 will be described later.

(Lock Mechanism)

The configuration of the lock mechanism 60 that locks the relative rotational phase in the intermediate locked phase will be described based on FIG. 3 and FIG. 4.

The lock mechanism 60 is primarily configured of the stepped cylindrical lock member 6, the lock member housing portion 61 that is formed in the partition portion 31 of the inner rotor 3 and that houses the lock member 6, and the round hole-shaped locking recess 62 formed in the surface of the rear plate 21 so that the lock member 6 can be inserted thereinto.

The lock member 6 has a shape in which, for example, cylinders of different diameters are stacked so as to form three steps. These cylinders forming three steps will be referred to as a first step portion 6*a, a* second step portion 6*b*, and a third step portion 6*c*, in that order from the side where the rear plate 21 is located. The first step portion 6*a*, the second step portion 6*b*, and the third step portion 6*c* are configured so that the diameters thereof increase in that order.

The first step portion 6*a* is formed so as to be capable of being inserted into the locking recess 62, and the relative rotational phase is locked in the intermediate locked phase when the first step portion 6*a* is inserted into the locking recess 62. A cylindrical recess portion 6*f* is formed spanning the third step portion 6*c* and part of the second step portion 6*b*, and a spring 63 is housed therein. In addition, a through-hole 6*g* is formed in a central area of the lock member 6 in order to reduce the resistance of the fluid when the lock member 6 moves in the direction of the bias and accordingly improve the operability.

A plug member 64 is provided between the lock member 6 and the front plate 22, and the spring 63 is disposed between the plug member 64 and a bottom surface of the recess portion 6*f*. A cutout portion 64*a* formed in the plug member 64 makes it possible to discharge the fluid outside of the valve timing control device 1 through a discharge flow path, which is not shown, when the lock member 6 moves toward the front plate 22, and contributes to the operability of the lock member 6.

The lock member housing portion 61 is formed in the partition portion 31 of the inner rotor 3 along the direction of the rotational core, and passes through the partition portion 31 from the side on which the front plate 22 is located to the side on which the rear plate 21 is located. The lock member housing portion 61 is formed having a shape in which, for example, cylindrical spaces of different diameters are stacked so as to form three steps, so that the lock member 6 can move within the inner space thereof.

The lock member 6 is housed within the lock member housing portion 61 and is continually biased toward the rear plate 21 by the spring 63. When the first step portion 6*a* of the lock member 6 is inserted into the locking recess 62, the relative rotational phase is locked in the intermediate locked phase, thus achieving a "locked state". When the first step portion 6*a* retracts from the locking recess 62 against the biasing force of the spring 63, the locked state is released, thus achieving a "lock released state".

When the lock member 6 is housed within the lock member housing portion 61, a cyclic second fluid chamber 65 and a cyclic third fluid chamber 66 are formed between an outer circumferential surface of the lock member 6 and an inner circumferential surface of the lock member housing portion 61. When the fluid is supplied to the second fluid chamber 65 and the fluid pressure acts on a second pressure receiving surface 6*d*, the lock member 6 moves toward the front plate 22 against the biasing force of the spring 63, resulting in the lock released state. Meanwhile, when the fluid is supplied to the third fluid chamber 66 and the fluid pressure acts on a third pressure receiving surface 6*e*, the lock member 6 is held in the lock released state. A configuration of a flow path for supplying/discharging the fluid to/from the second fluid chamber 65 and the third fluid chamber 66 will be described later.

Next, a restriction lifting flow path, a drain flow path, a lock release flow path, and a communication flow path will be described based on FIG. 3 to FIG. 13.

(Restriction Lifting Flow Path)

A restriction lifting flow path for achieving the restriction lifted state includes a restriction communication channel 82 and a lifting communication channel 83. The restriction communication channel 82 is configured of a rear plate channel 84, a first through-channel 85*a*, and a supply path 85*c*, which will be described later, and is a flow path for supplying the fluid to the first fluid chamber 55 in order to lift the restricted state. Meanwhile, the lifting communication channel 83 is a channel for supplying the fluid to the first fluid chamber 55 in order to hold the restriction lifted state when the restriction member 5 is retracted from the restriction recess 52.

The rear plate channel 84 is a groove-shaped channel formed in the a surface of the rear plate 21 on the side toward the inner rotor 3, and communicates with the advanced angle chamber 41. The rear plate channel 84 is configured to be capable of communicating with the first through-channel 85*a* that forms part of a rotor channel 85, which will be mentioned later, only when the restriction member 5 is within a predetermined range on the retarded-side of the restriction range R (called a "restriction liftable range T" hereinafter). Note that the restriction member 5 being within the range of the restriction liftable range T corresponds to the first step portion 5*a* of the restriction member 5 being completely located within the region of the restriction liftable range T.

The rotor channel 85 is a channel formed in the inner rotor 3, and is configured of the first through-channel 85*a, a* second through-channel 85*b*, the supply path 85*c*, and a discharge path 85*d*. The first through-channel 85*a* and the second through-channel 85*b* are formed in a side surface of the partition portion 31 of the inner rotor 3 on the outer side thereof in the radial direction, and are formed as a continuous straight groove along the direction of the rotational core. Of this straight groove, an area closer to the rear plate 21 than the supply path 85*c* corresponds to the first through-channel 85*a*, and an area closer to the front plate 22 than the supply path

85*c* corresponds to the second through-channel 85*b*. An end portion of the first through-channel 85*a* on the side thereof toward the rear plate 21 is configured to communicate with the rear plate channel 84 when the restriction member 5 is within the range of the restriction liftable range T. Meanwhile, an end portion of the second through-channel 85*b* on the side thereof toward the front plate 22 is connected to the discharge path 85*d*.

The supply path 85*c* branches at border area between the first through-channel 85*a* and the second through-channel 85*b*, and communicates with the first fluid chamber 55. The discharge path 85*d* is formed in the surface of the partition portion 31 of the inner rotor 3 on the side thereof located toward the front plate 22, in an L shape when viewed from above, and is configured to communicate with a discharge hole 87, which will be mentioned later, only when the restriction member 5 is in a predetermined area on the advanced-side relative to the restriction liftable range T.

As described above, the restriction communication channel 82 is configured of the rear plate channel 84, the first through-channel 85*a*, and the supply path 85*c*. Accordingly, when the restriction member 5 is within the restriction liftable range T, the rear plate channel 84 and the first through-channel 85*a* communicate with each other, causing the restriction communication channel 82 to communicate with the first fluid chamber 55 and fluid to be supplied from the advanced angle chamber 41; as a result, the fluid pressure acts on the first pressure receiving surface 5*e* and the restricted state is lifted.

The lifting communication channel 83 is a pipe-shaped channel formed in the partition portion 31 of the inner rotor 3, and communicates with the advanced angle chamber 41. When the restriction member 5 retracts from the restriction recess 52 and the restriction lifted state is achieved, the lifting communication channel 83 communicates with the first fluid chamber 55 and supplies the fluid from the advanced angle chamber 41; as a result, the fluid pressure acts on the first pressure receiving surface 5*e* and the restriction lifted state is held.

Note that the configuration is such that when the restriction member 5 moves toward the front plate 22 against the biasing force of the spring 53, the communication between the supply path 85*c* and the first fluid chamber 55 is cut off by the first step portion 5*a* at the timing when the lifting communication channel 83 communicates with the first fluid chamber 55. In other words, the channel that supplies the fluid to the first fluid chamber 55 is configured to alternate between the restriction communication channel 82 and the lifting communication channel 83. According to this configuration, in the case where the fluid is to be discharged from the first fluid chamber 55, the supply of the fluid from the lifting communication channel 83 can be cut off while still discharging the fluid from the first fluid chamber 55 via the supply path 85*c* (which is part of a drain flow path 86, which will be mentioned later).

However, strictly speaking, the configuration is such that the fluid is supplied to the first fluid chamber 55 from both the restriction communication channel 82 and the lifting communication channel 83 when switching between the restriction communication channel 82 and the lifting communication channel 83. This is because if a situation where neither the restriction communication channel 82 nor the lifting communication channel 83 is connected to the first fluid chamber 55 when switching between those communication channels, the first fluid chamber 55 will become temporarily sealed, and the smoothness of the restriction/lifting operations of the restriction member 5 will be lost.

(Drain Flow Path)

The drain flow path 86 is open to the atmosphere outside of the valve timing control device 1, and is a channel for reducing movement resistance of the restriction member 5 and quickly discharging the fluid within the first fluid chamber 55 when the restriction member 5 is inserted into the restriction recess 52. The drain flow path 86 is configured of the supply path 85*c*, the second through-channel 85*b*, the discharge path 85*d*, and the discharge hole 87. The discharge hole 87 passes through the front plate 22 along the direction of the rotational core.

The discharge path 85*d* and the discharge hole 87 are configured so as to communicate only when the restriction member 5 is in a predetermined range on the advanced-side relative to the restriction liftable range T and to not communicate when the restriction member 5 is within the restriction liftable range T. According to this configuration, the fluid supplied from the advanced angle chamber 41 is prevented from being discharged directly through the drain flow path 86 when the rear plate channel 84 and the first through-channel 85*a* communicate.

(Lock Release Flow Path)

A lock release flow path 88 is a pipe-shaped channel formed in the partition portion 31 of the inner rotor 3, and communicates with the retarded angle chamber 42. The lock release flow path 88 is a flow path for supplying the fluid to the second fluid chamber 65 from the retarded angle chamber 42 and causing the fluid pressure to act on the second pressure receiving surface 6*d*, which in turn causes the lock member 6 to retract from the locking recess 62.

(Communication Flow Path)

A communication flow path 89 is a pipe-shaped flow path formed so as to connect the restriction member housing portion 51 and the lock member housing portion 61. When the restriction member 5 is retracted from the restriction recess 52 and the lock member 6 is retracted from the locking recess 62, the communication flow path 89 causes the first fluid chamber 55 to communicate with the third fluid chamber 66. When the lifting communication channel 83, the first fluid chamber 55, the communication flow path 89, and the third fluid chamber 66 communicate, the fluid supplied to the first fluid chamber 55 from the advanced angle chamber 41 is also supplied to the third fluid chamber 66, and thus the restriction lifted state and the lock released state can be held.

(Operations During Lock Release and Restriction Lift)

A procedure for releasing the locked state using the restriction mechanism 50, the lock mechanism 60, and the respective flow channels described above will be described based on FIG. 5 to FIG. 8.

Figure 5A:
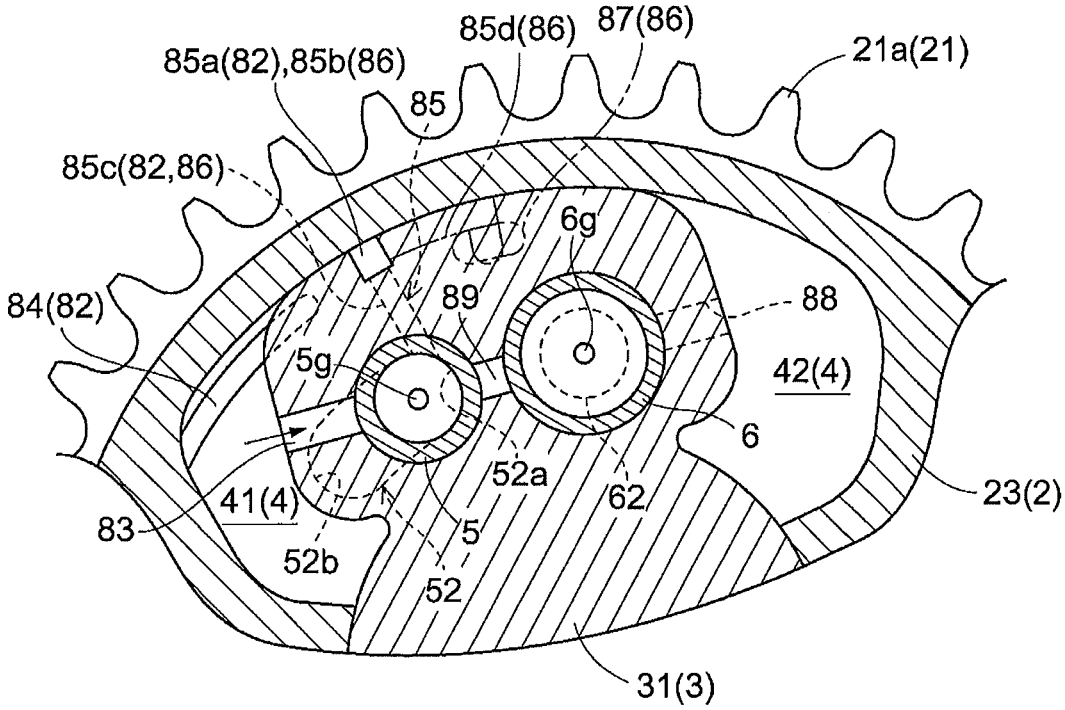
FIG. 5A is a plan view illustrating states of the restriction mechanism and the lock mechanism when an engine is started.
Figure 5B:
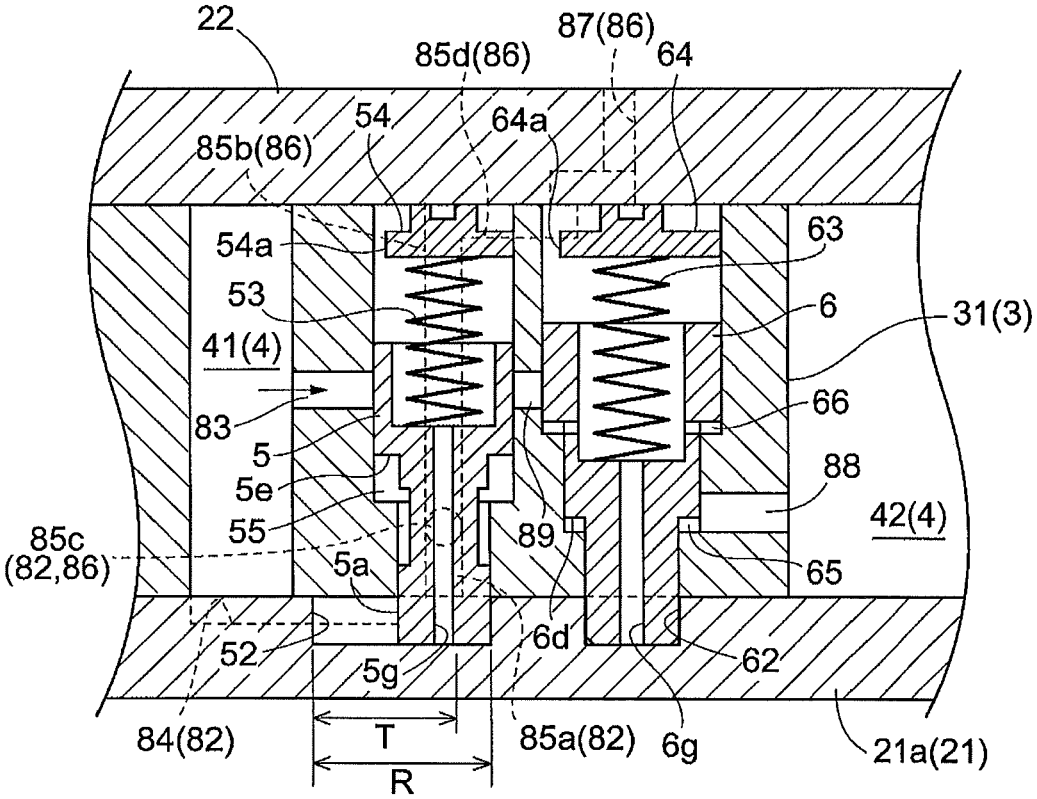
FIG. 5B is a cross-sectional view illustrating states of the restriction mechanism and the lock mechanism when an engine is started.

FIG. 5 illustrates a state occurring when the engine is started. When the engine is started, the advanced/retarded control valve 72 is at the first position 72*a*, and thus advancement control is carried out. However, because the restriction member 5 is outside of the range of the restriction liftable range T, the fluid is not supplied to the first fluid chamber 55 from the restriction communication channel 82. In addition, because the lifting communication channel 83 also does not communicate with the first fluid chamber 55, the fluid is not supplied to the first fluid chamber 55. Accordingly, the locked state is maintained.

Figure 6A:
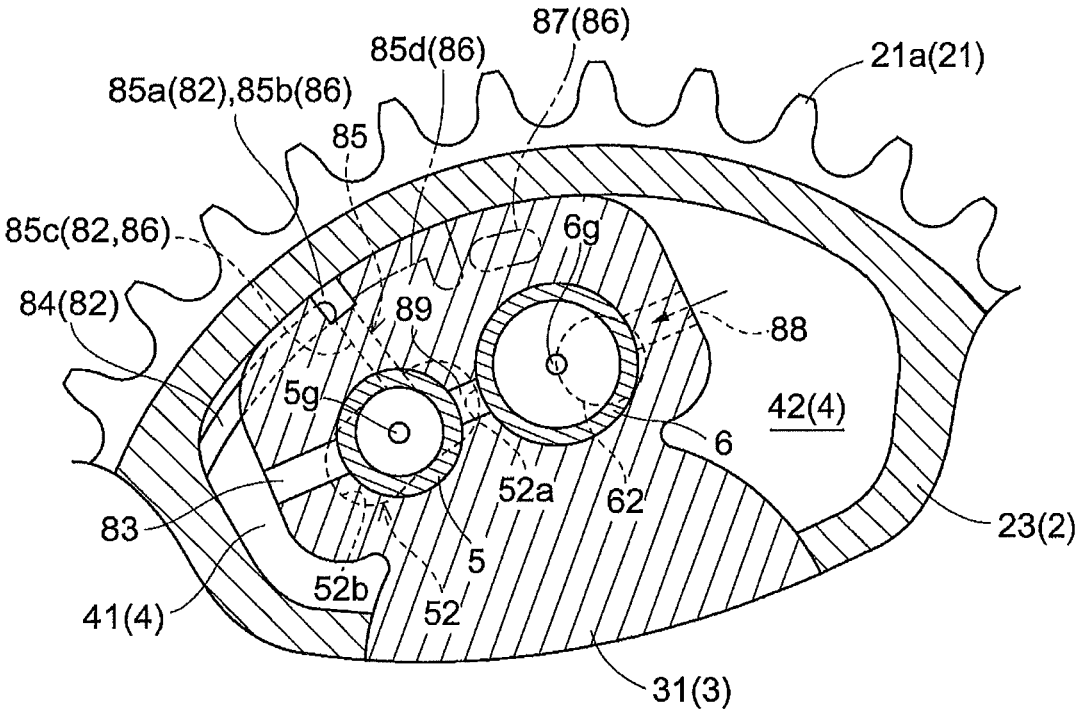
FIG. 6A is a plan view illustrating states of the restriction mechanism and the lock mechanism when a locked state is released.
Figure 6B:
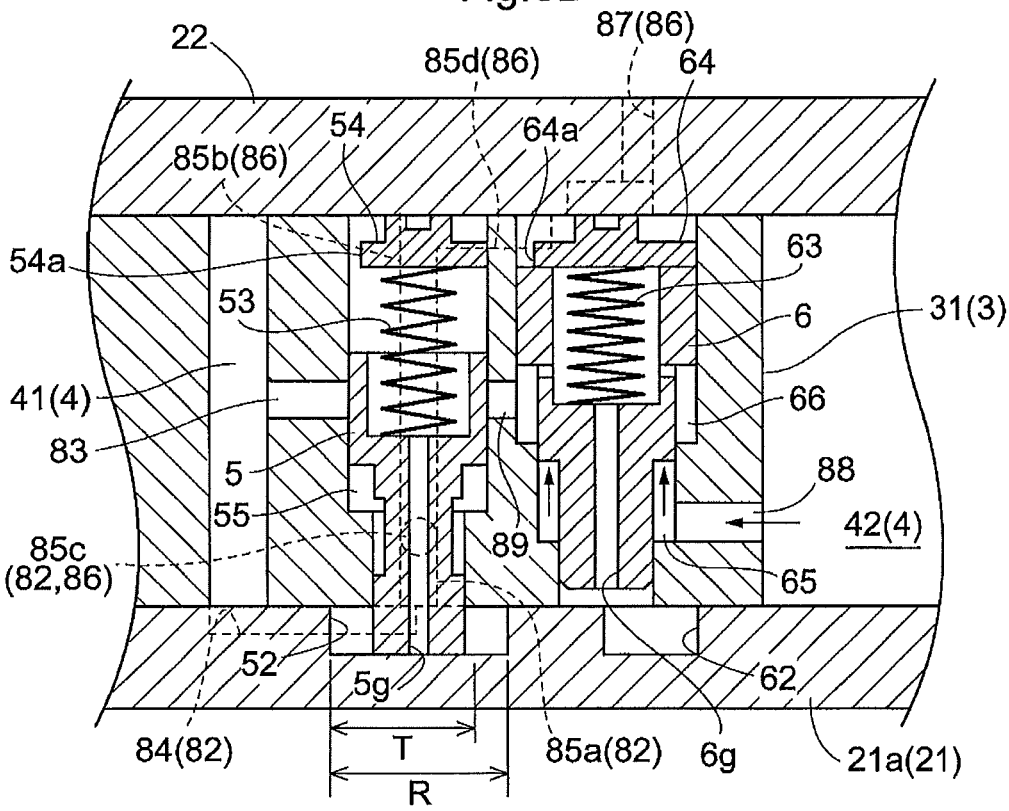
FIG. 6B is a cross-sectional view illustrating states of the restriction mechanism and the lock mechanism when a locked state is released.

FIG. 6 illustrates a state after the engine has started, when the control has first been switched to retardation control in order to release the locked state. At this time, the fluid is supplied to the second fluid chamber 65 from the retarded angle chamber 42 via the lock release flow path 88, the lock member 6 retracts from the locking recess 62, and the locked state is released. The restriction member 5 moves in the retarded direction S2 within the restriction recess 52 when the locked state is released.

Figure 7A:
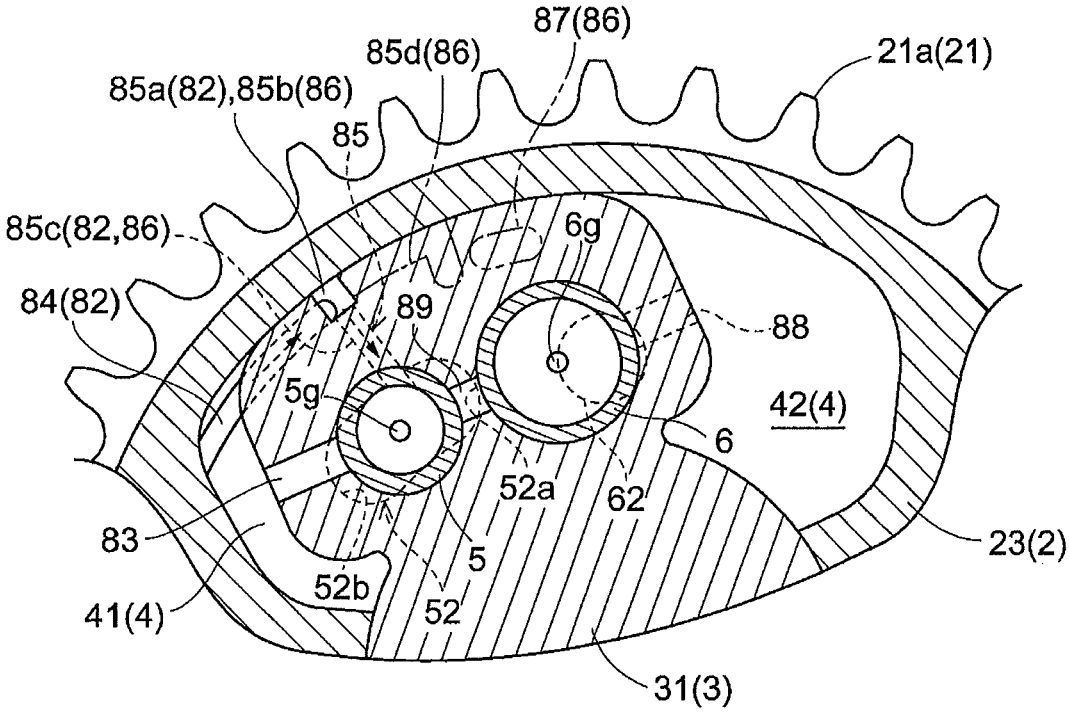
FIG. 7A is a plan view illustrating states of the restriction mechanism and the lock mechanism when a restricted state is lifted.
Figure 7B:
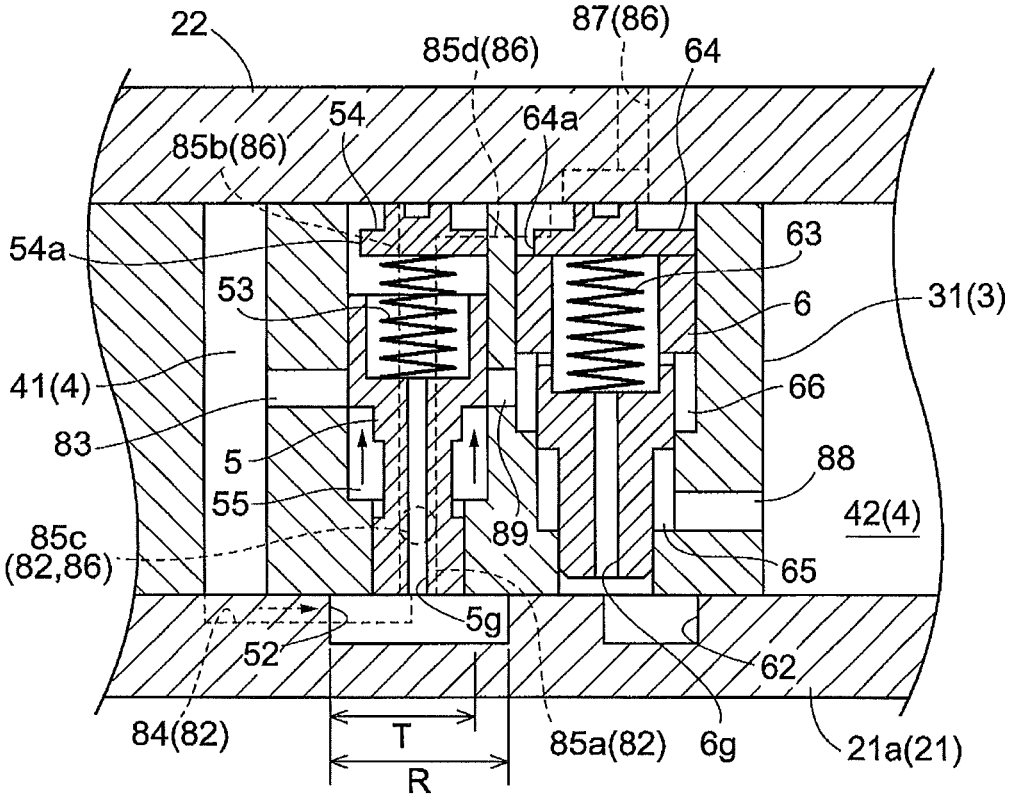
FIG. 7B is a cross-sectional view illustrating states of the restriction mechanism and the lock mechanism when a restricted state is lifted.

When an angle sensor, which is not shown, that detects a rotational angle of the cam shaft 9, has detected that a relative rotational phase in which the restriction member 5 is located within the range of the restriction liftable range T has been achieved, the ECU 73 switches to advancement control. This state is shown in FIG. 7. The rear plate channel 84 and the first through-channel 85*a* communicate, and thus the fluid is supplied to the first fluid chamber 55 from the advanced angle chamber 41 via the restriction communication channel 82. As a result, the restriction member 5 retracts from the restriction recess 52 and the restricted state is lifted.

If there is error between the angle detected by the angle sensor and the actual relative rotational phase, there are cases where the restriction member 5 has actually not reached the range of the restriction liftable range T despite the angle sensor detecting a relative rotational phase in which the restriction member 5 is located within the range of the restriction liftable range T. In such a case, the restriction communication channel 82 and the first fluid chamber 55 do not communicate even if the control is switched to the advancement control; thus the fluid is not supplied to the first fluid chamber 55 from the advanced angle chamber 41 via the restriction communication channel 82, and the restricted state cannot be lifted.

In order to solve such a problem, in the present embodiment, the configuration is such that the control does not switch to the advancement control immediately after the angle sensor has detected the relative rotational phase in which the restriction member 5 is located within the range of the restriction liftable range T, and instead, the retardation control is continued for a predetermined amount of time after the detection, ensuring that the restriction member 5 is located within the range of the restriction liftable range T. By employing such a configuration, the restricted state can be lifted with certainty. Note that the sensor for detecting the relative rotational phase is not limited to an angle sensor that detects the rotational angle of the cam shaft 9, and other sensors may be used as well.

Figure 8A:
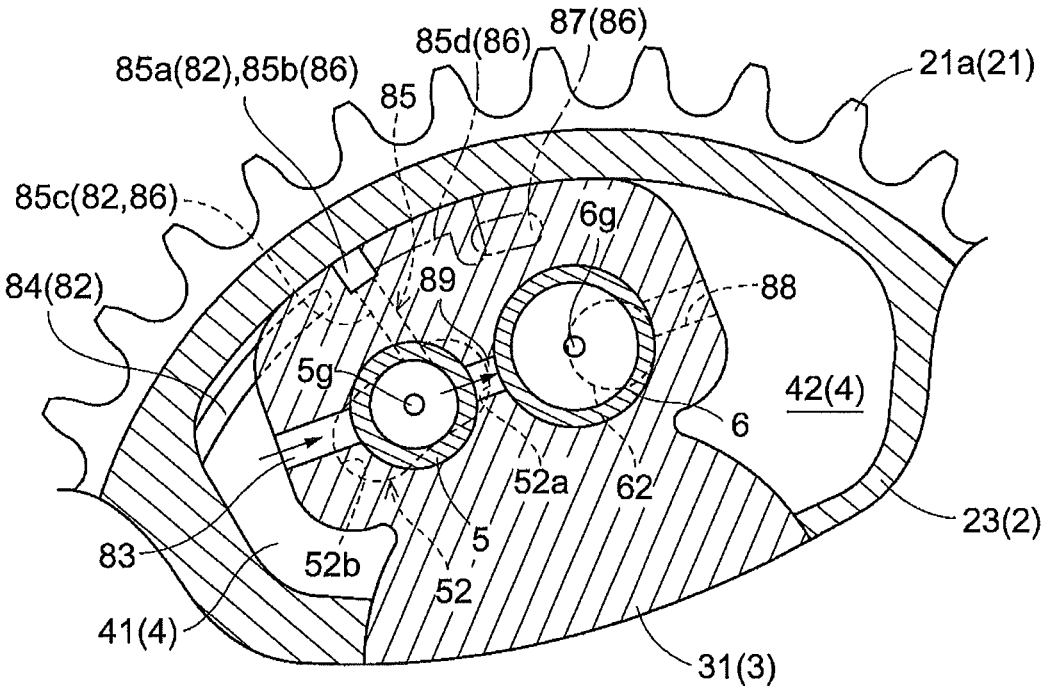
FIG. 8A is a plan view illustrating states of the restriction mechanism and the lock mechanism when holding a restriction lifted state and a lock released state.
Figure 8B:
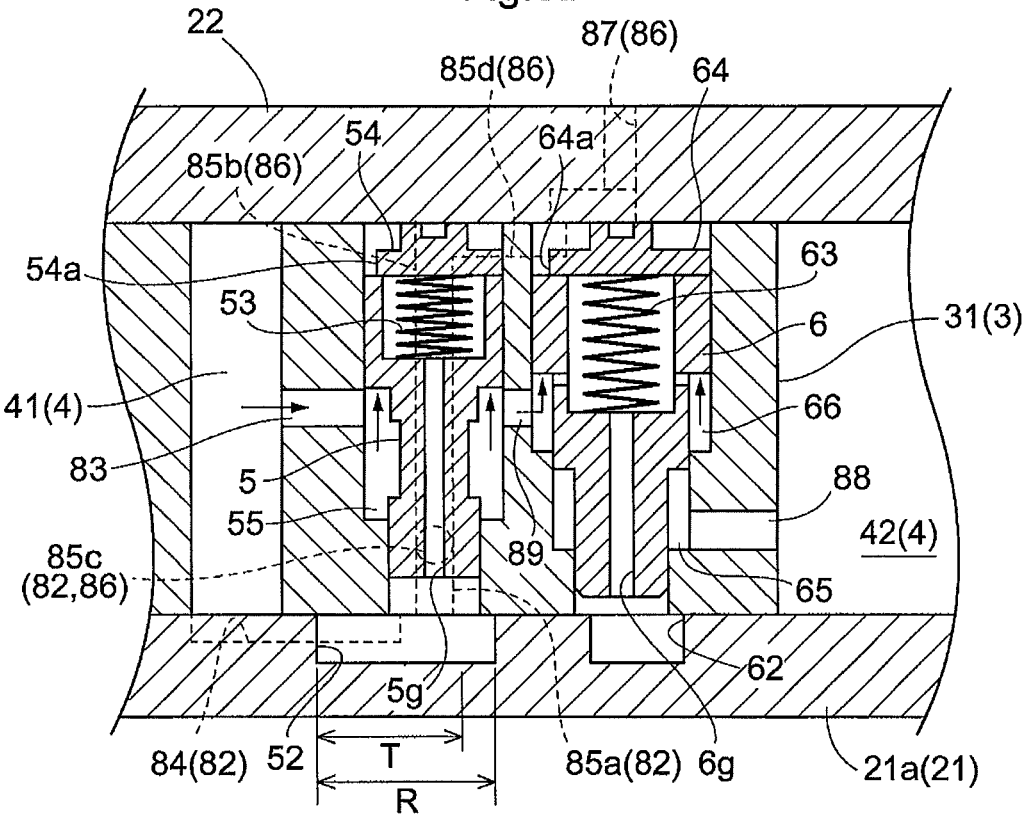
FIG. 8B is a cross-sectional view illustrating states of the restriction mechanism and the lock mechanism when holding a restriction lifted state and a lock released state.

FIG. 8 illustrates a state in which the restriction lifted state and the lock released state are held as a result of the advancement control. At this time, the first fluid chamber 55 and the third fluid chamber 66 communicate via the communication flow path 89, and thus the fluid supplied to the first fluid chamber 55 from the advanced angle chamber 41 is also supplied to the third fluid chamber 66. As a result, the restriction lifted state and the lock released state are held.

(Operations During Normal Driving State)

Next, operations performed in a normal driving state where the restriction lifted state and the lock released state are achieved through the aforementioned procedures will be described based on FIG. 9 and FIG. 10.

Figure 9A:
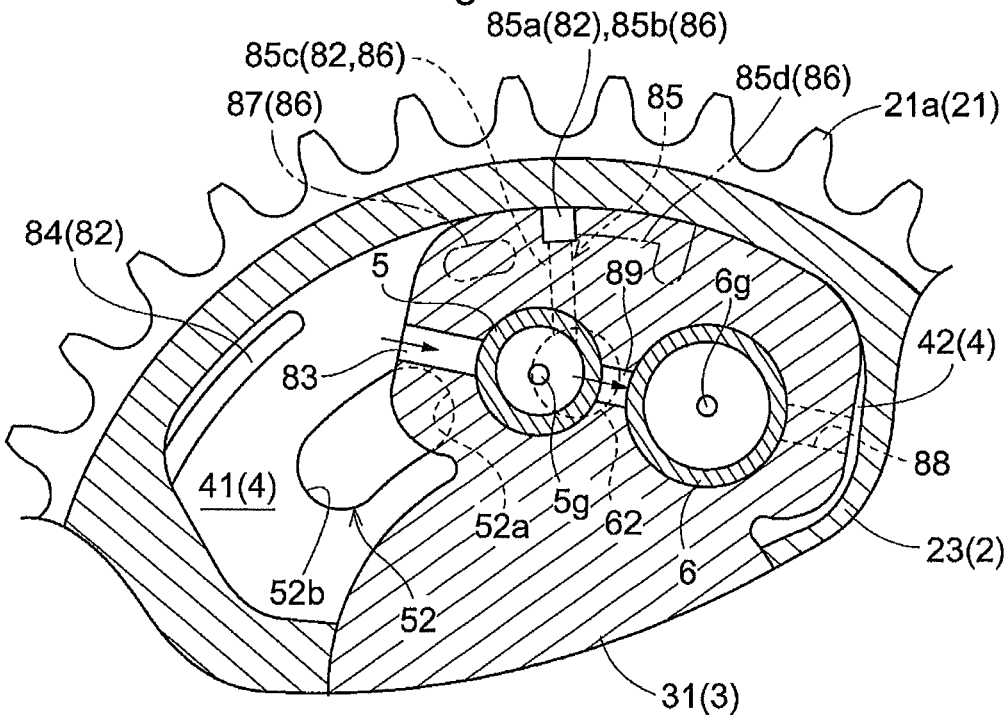
FIG. 9A is a plan view illustrating states of the restriction mechanism and the lock mechanism during advancement control in a normal driving state.
Figure 9B:
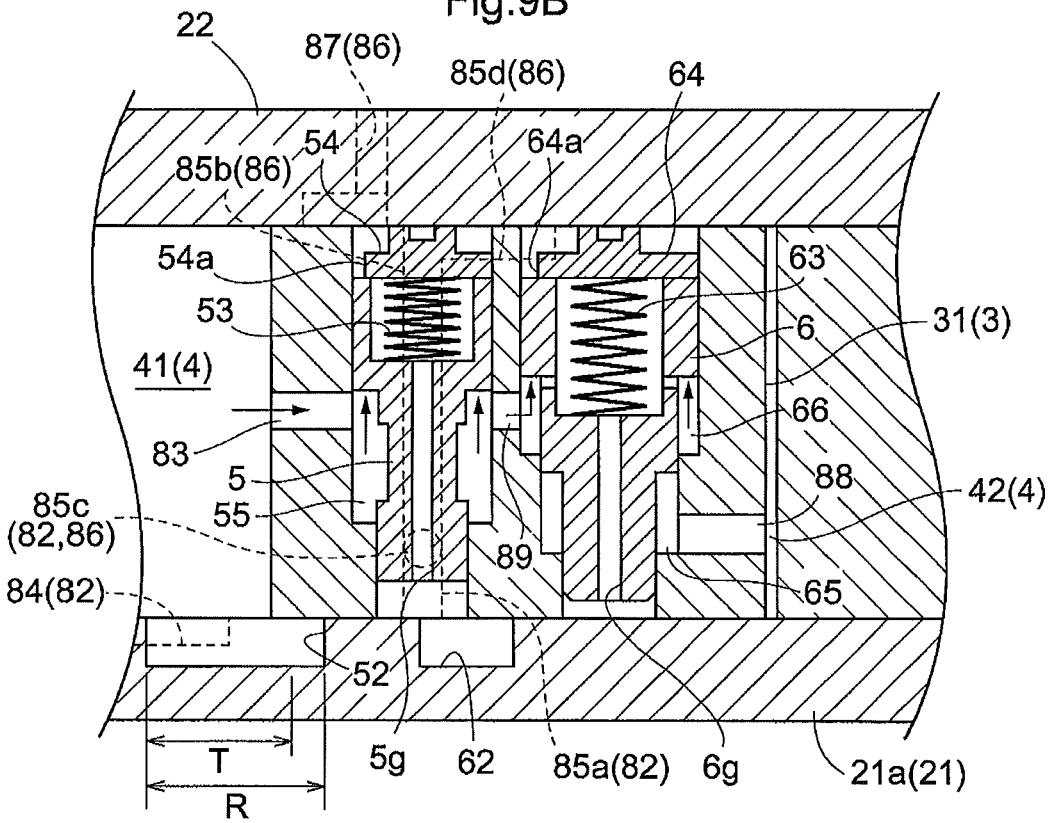
FIG. 9B is a cross-sectional view illustrating states of the restriction mechanism and the lock mechanism during advancement control in a normal driving state.

FIG. 9 illustrates a state occurring when the advancement control is carried out during the normal driving state. As described above, during the advancement control, the advanced angle chamber 41, the lifting communication channel 83, the first fluid chamber 55, the communication flow path 89, and the third fluid chamber 66 communicate, and thus the advancement operation occurs in a state where the restriction lifted state and the lock released state are held.

Figure 10A:
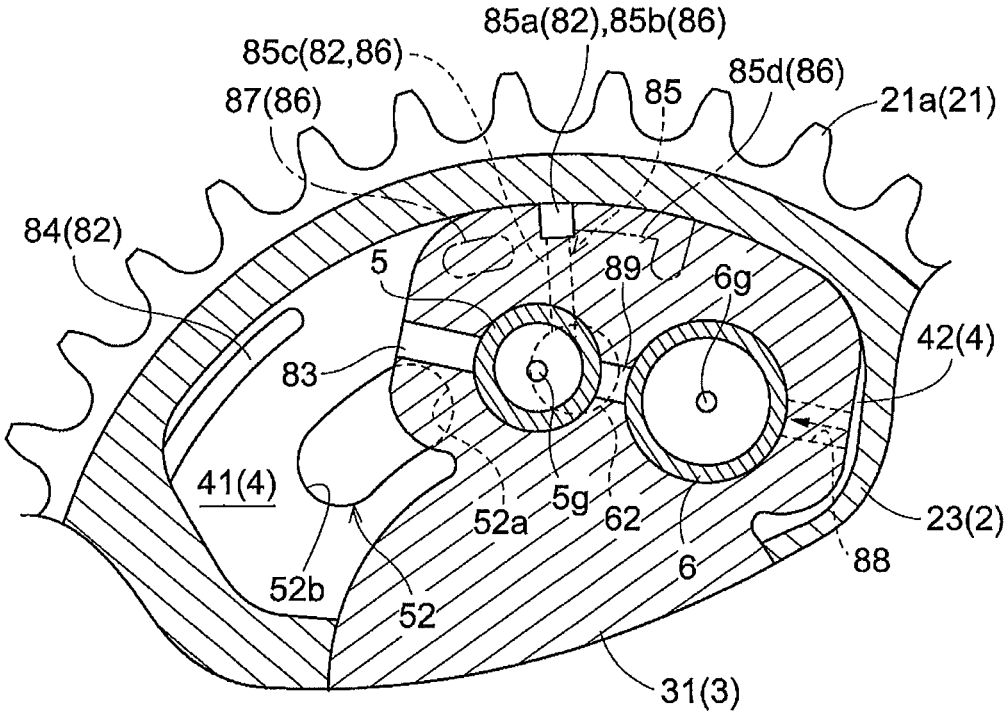
FIG. 10A is a plan view illustrating states of the restriction mechanism and the lock mechanism during retardation control in a normal driving state.
Figure 10B:
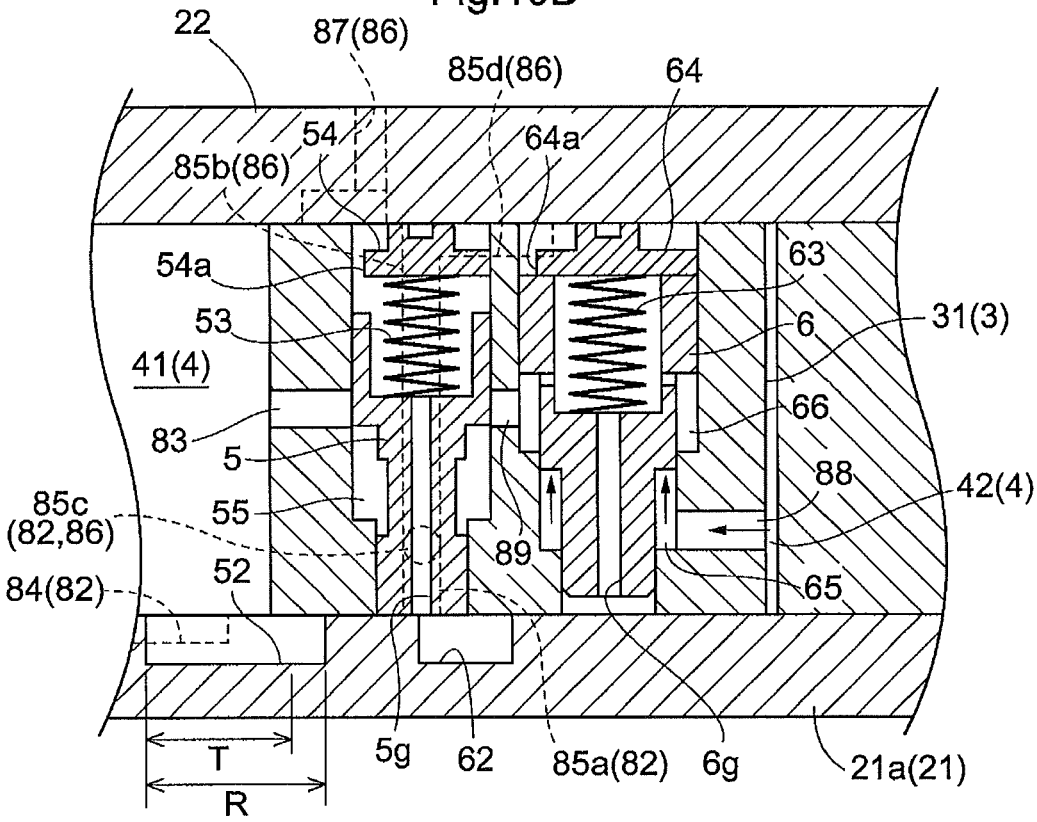
FIG. 10B is a cross-sectional view illustrating states of the restriction mechanism and the lock mechanism during retardation control in a normal driving state.

FIG. 10 illustrates a state occurring when the retardation control is carried out during the normal driving state. At this time, the fluid is supplied to the second fluid chamber 65 from the retarded angle chamber 42, and thus the lock released state is held. On the other hand, the fluid is not supplied to the first fluid chamber 55, and thus the restriction member 5 is biased toward the rear plate 21 by the spring 53 and makes contact with the rear plate 21. However, because the restriction member 5 slides along the surface of the rear plate 21, the driving is not interfered with. Furthermore, because the restriction recess 52 and the locking recess 62 are formed in positions that are shifted in the radial direction, the restriction member 5 does not enter into the locking recess 62.

(Operations During Restriction and Locking)

Finally, a procedure for entering the locked state after achieving the restricted state will be described based on FIG. 11 to FIG. 13.

Figure 11A:
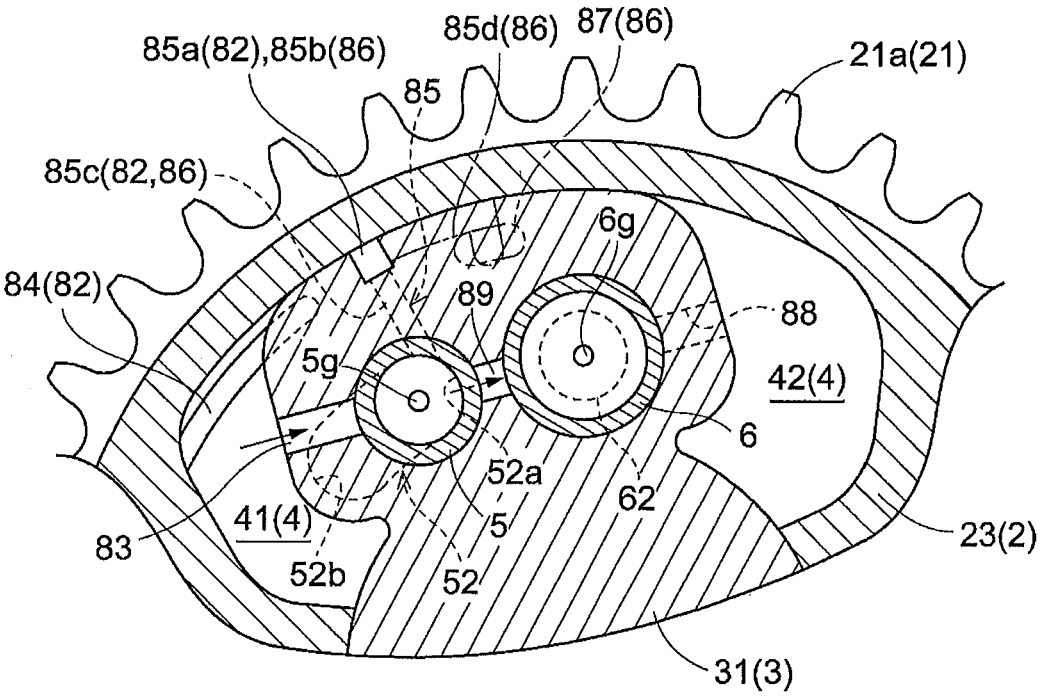
FIG. 11A is a plan view illustrating states of the restriction mechanism and the lock mechanism when starting a lock operation.
Figure 11B:
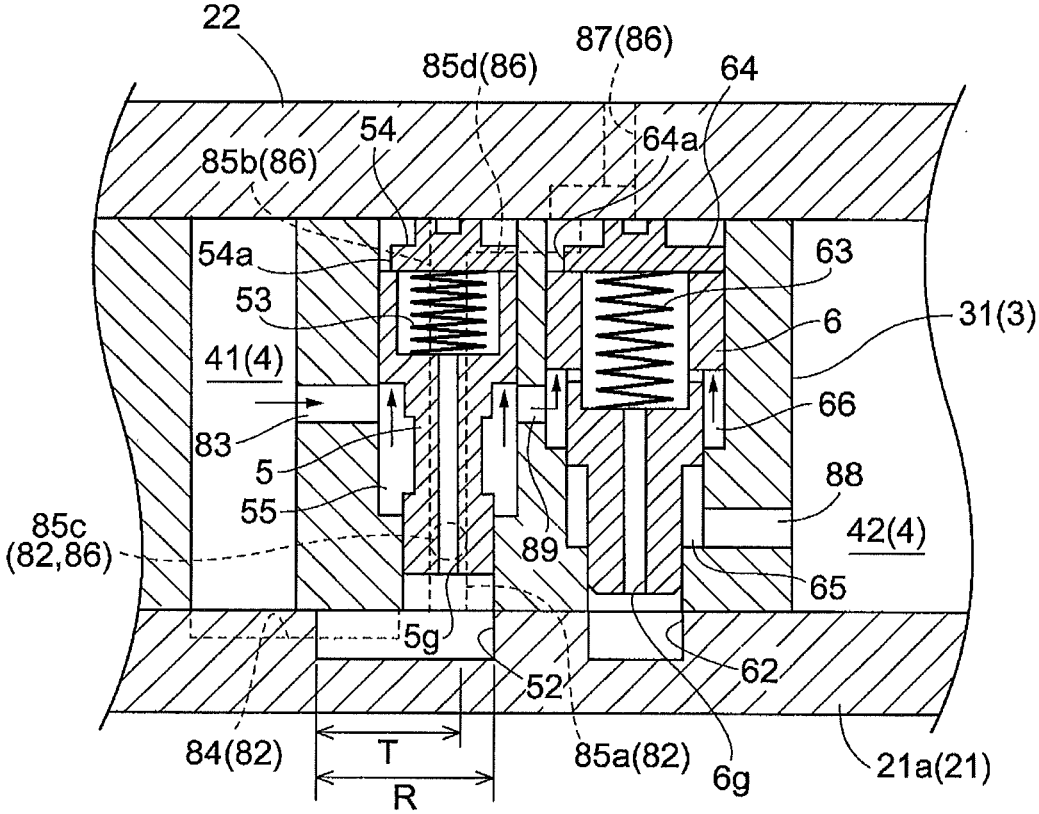
FIG. 11B is a cross-sectional view illustrating states of the restriction mechanism and the lock mechanism when starting a lock operation.

FIG. 11 illustrates a state in which the discharge path 85*d* and the discharge hole 87 communicate and the phase is rotated, as a result of the advancement control, to a position where the drain flow path 86 functions. At this time, the fluid is supplied to the first fluid chamber 55 and the third fluid chamber 66 from the advanced angle chamber 41, and thus the restriction lifted state and the lock released state are held (a "first state" according to the present invention). Because the drain flow path 86 is communicating, the restricted state can be achieved smoothly when the restriction member 5 is inserted into the restriction recess 52 according to the following procedure.

Figure 12A:
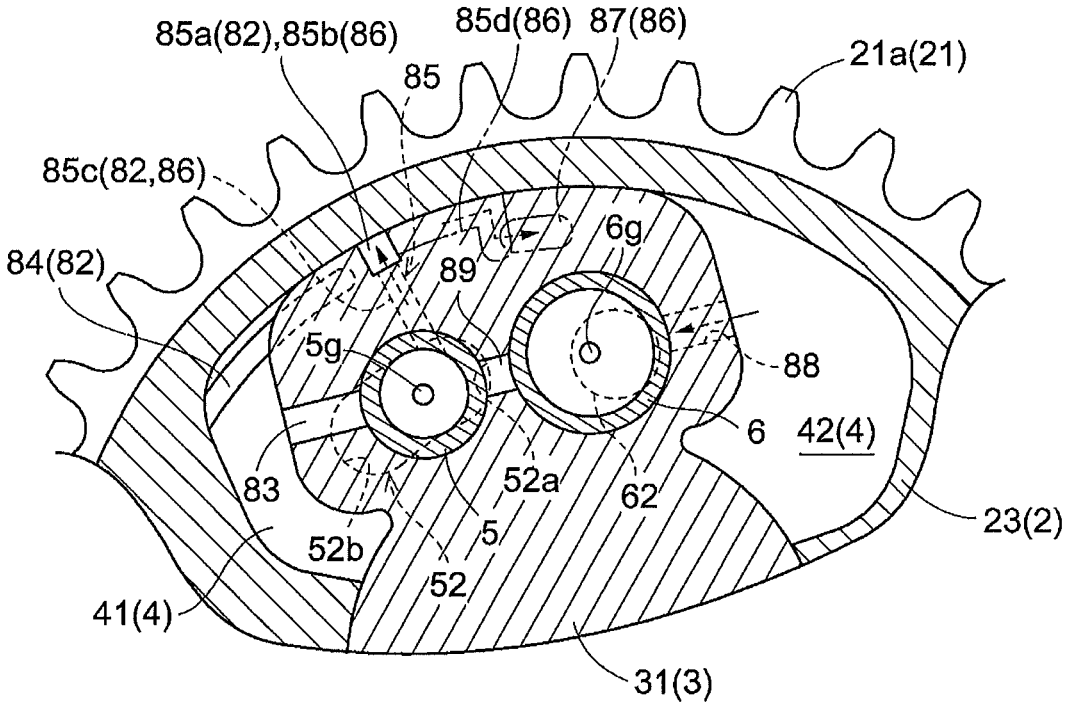
FIG. 12A is a plan view illustrating states of the restriction mechanism and the lock mechanism when achieving the restricted state.
Figure 12B:
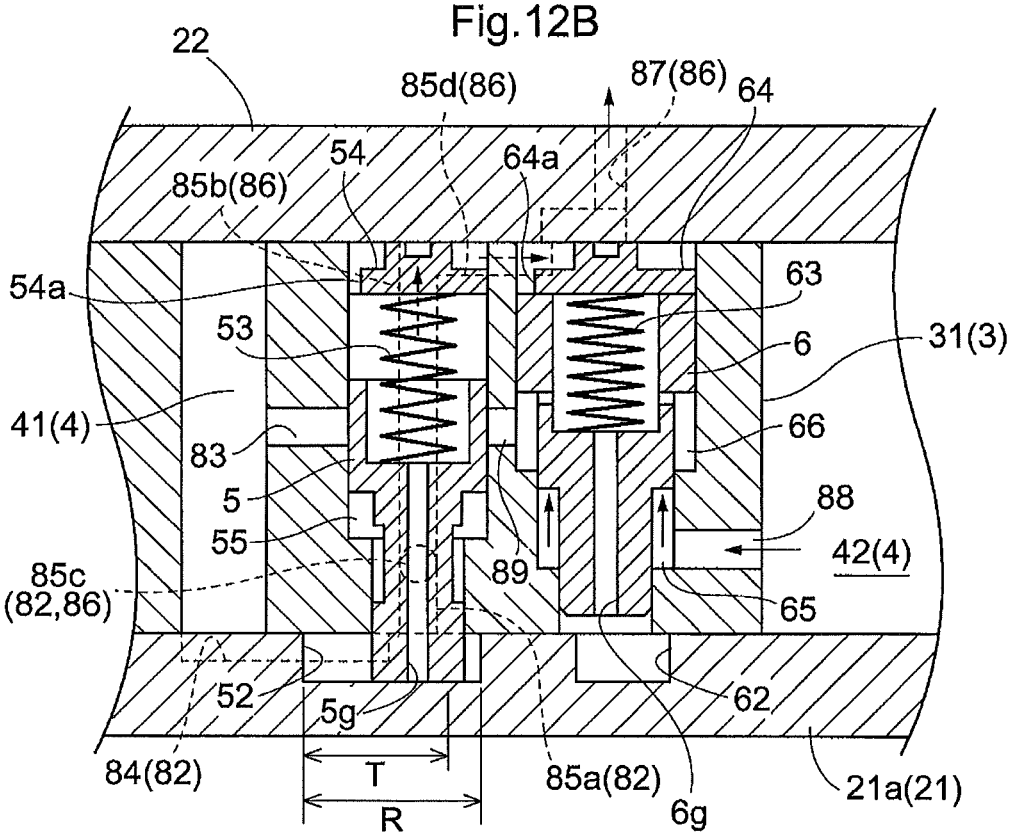
FIG. 12B is a cross-sectional view illustrating states of the restriction mechanism and the lock mechanism when achieving the restricted state.
Figure 13A:
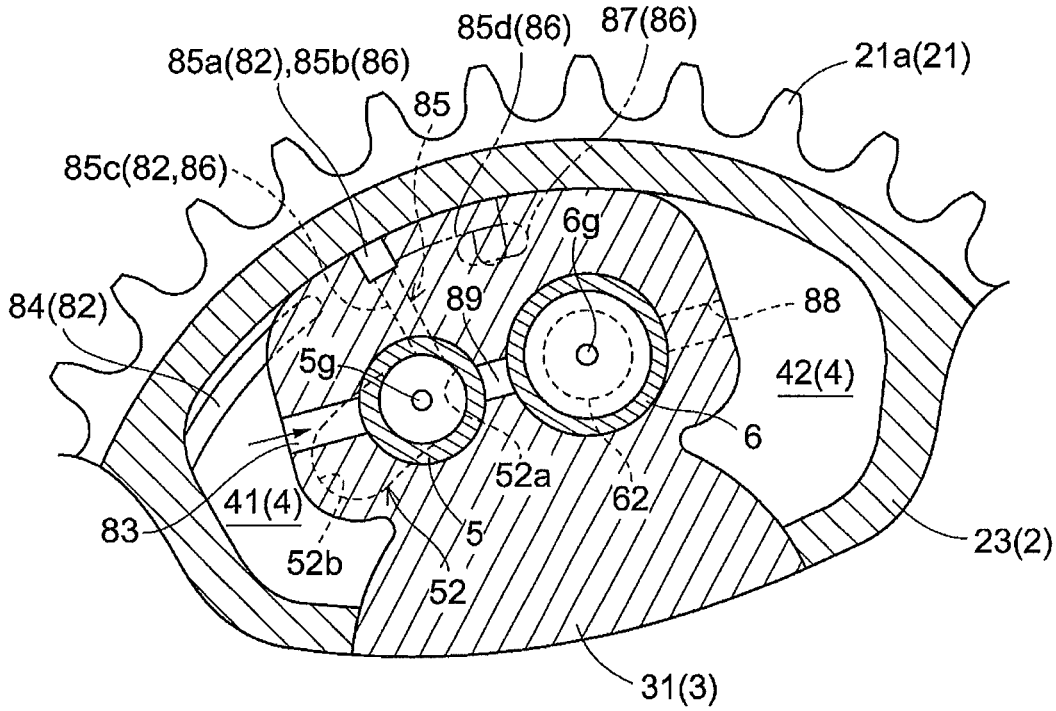
FIG. 13A is a plan view illustrating states of the restriction mechanism and the lock mechanism during a locked state.
Figure 13B:
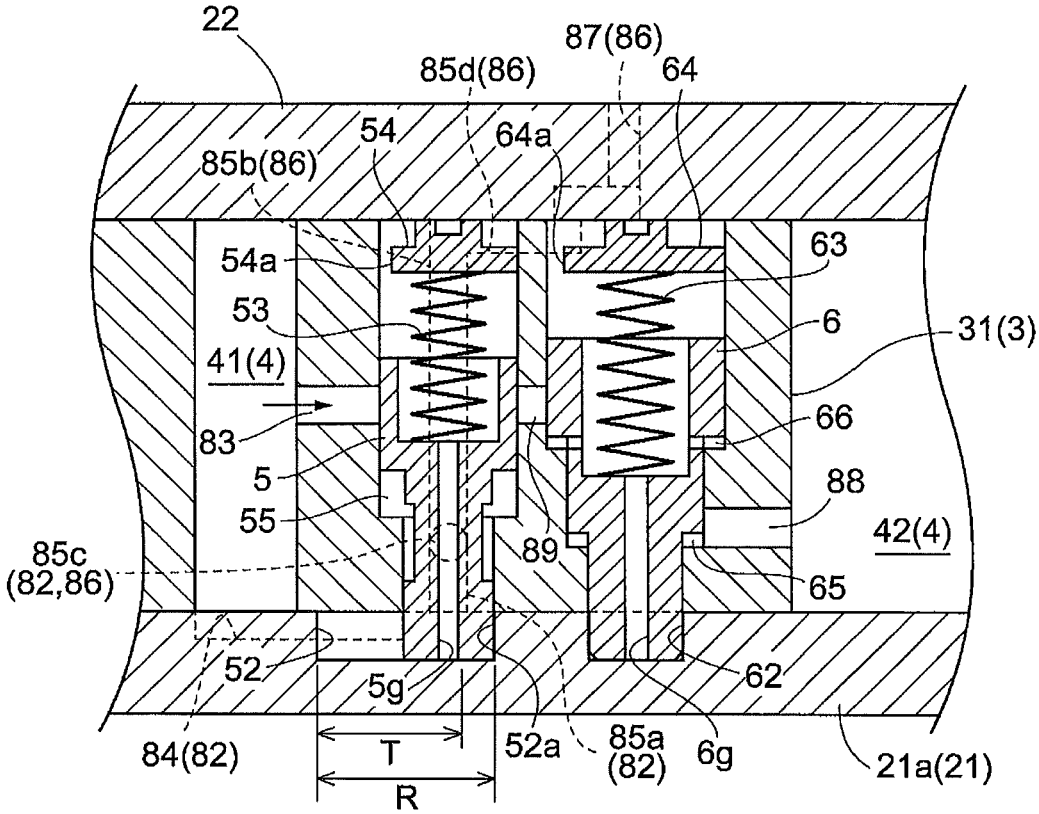
FIG. 13B is a cross-sectional view illustrating states of the restriction mechanism and the lock mechanism during a locked state.

FIG. 12 illustrates a state in which the control is switched to the retardation control and the restricted state is achieved (a "second state" according to the present invention). Here, if the operation for inserting the restriction member 5 into the restriction recess 52 takes a long time, there will be cases where the restriction member 5 is already located within the range of the restriction liftable range T when the restricted state is achieved. If such is the case, there is a risk that the fluid will be supplied to the first fluid chamber 55 from the advanced angle chamber 41 via the restriction communication channel 82 and the restricted state will be lifted when switching to the advancement control for achieving the next locked state.

In order to avoid such a problem, in the present embodiment, the configuration is such that a minimum cross-sectional area of the advanced passage 43 that supplies the fluid to the advanced angle chamber 41 is greater than a minimum cross-sectional area of the retarded passage 44 that supplies the fluid to the retarded angle chamber 42. With such a configuration, the fluid is easier to discharge from the advanced angle chamber 41 during the retardation control, and furthermore, the discharge of the fluid from the first fluid chamber 55 via the lifting communication channel 83 is prompted as well. Accordingly, the restriction member 5 can be rapidly inserted into the restriction recess 52 when switching to the retardation control, and thus the restricted state can be achieved with certainty.

When the control is switched to the advancement control before the next time the restriction member 5 enters in the restriction liftable range T, the fluid is not supplied to the first fluid chamber 55 from the advanced angle chamber 41 via the restriction communication channel 82, and thus the advancement operation proceeds without the restriction member 5 retracting from the restriction recess 52. As a result, as shown in FIG. 13, the restriction member 5 makes contact with the first end portion 52*a* of the restriction recess 52. At this time, the supply of the fluid to the communication flow path 89 is cut off; accordingly, the lock member 6 is biased by the spring 63, enters into the locking recess 62, and the restricted state and the locked state are achieved (a "third state" according to the present invention).

As described above, according to the present embodiment, it is possible to freely switch between the first state, the second state, and the third state using advancement/retardation control. Accordingly, the locked state can be achieved while repeating the advancement/retardation control, even in the case where the locked state could not be achieved due to the restriction member 5, the lock member 6, and so on not operating as planned. Accordingly, the locked state can be achieved with certainty while the engine is running.

As described above, after the restricted state has been achieved, it is necessary to switch to advancement control before the restriction member 5 is located within the range of the restriction liftable range T and the rear plate channel 84 and the first through-channel 85*a* communicate with each other. However, in the case where, for example, the angle sensor, which is not shown, that detects the rotational angle of the cam shaft 9, detects the relative rotational phase, error can arise between the angle detected by the angle sensor and the actual relative rotational phase. Due to this error, there are cases where the restriction member 5 has actually reached the range of the restriction liftable range T despite the angle sensor detecting a relative rotational phase in which the restriction member 5 is located outside of the range of the restriction liftable range T in the restriction range R. Because the restriction communication channel 82 and the first fluid chamber 55 are communicating with each other, if the control is switched to the advancement control in such a case, the fluid will be supplied to the first fluid chamber 55 from the advanced angle chamber 41 via the restriction communication channel 82, and the restricted state will be lifted as a result.

Figure 14:
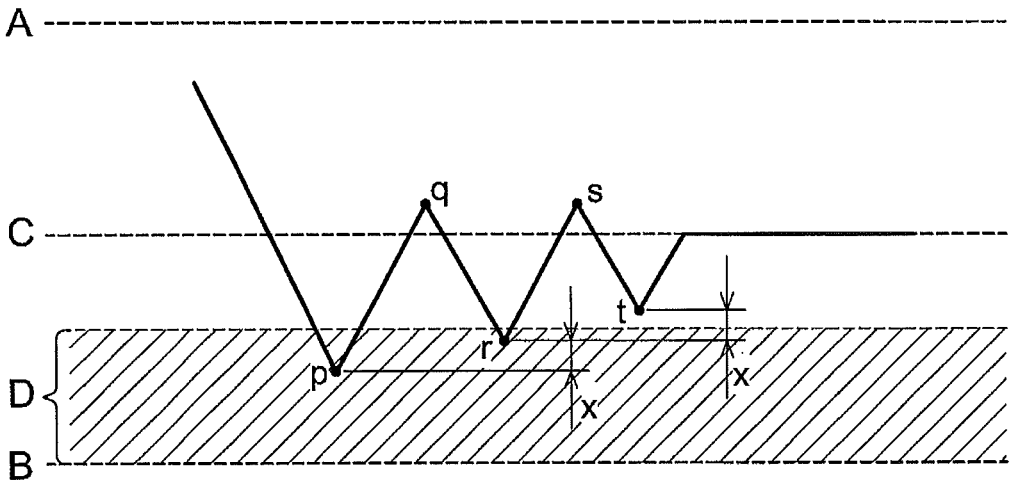
FIG. 14 is a diagram illustrating phase changes during retry control.

Retry control executed in the present embodiment in order to solve such a problem will be described based on FIG. 14. In FIG. 14, A indicates the maximum advanced phase, B indicates the maximum retarded phase, C indicates the locked phase, and D indicates a phase range where the rear plate channel 84 and the first through-channel 85*a* communicate with each other (called a "restriction liftable phase D" hereinafter). Note that the restriction liftable phase D is a phase that corresponds to the restriction liftable range T.

When the control is switched to the advancement control in the case where the angle sensor detects that the restriction liftable phase D has not been reached but the actual relative rotational phase has reached the restriction liftable phase D (a point p), the relative rotational movement will be further toward the advanced-side than the locked phase C. As a result, the ECU 73 determines that the locked state has not been achieved, and switches to the retardation control (a point q). The next switch to the advancement control (a point r) occurs at a relative rotational phase on the advanced-side by an amount equivalent to a predetermined interval x from the point p. However, if the relative rotational phase at the point r also corresponds to the restriction liftable phase D, the relative rotational movement will again be further toward the advanced-side than the locked phase C. As a result, the ECU 73 once again switches to the retardation control (a point s). Next, the control is switched to the advancement control at a relative rotational phase further on the advanced-side by an amount equivalent to a predetermined interval x from the point r (a point t). Because the relative rotational phase is outside of the range of the restriction liftable phase D at the point t, the restricted state can be achieved, and the locked state can then be achieved thereafter.

As described thus far, the locked state can be achieved with certainty by executing the retry control while shifting the relative rotational phase, at which the control is switched to the advancement control in order to achieve the locked state, toward the locked phase C by the predetermined intervals x. However, in the case where the error between the angle detected by the angle sensor and the actual relative rotational phase is temporary, it is not absolutely necessary to execute the retry control while shifting toward the locked phase C by the predetermined intervals x, and the phase at which the control is switched to the advancement control may be determined based on the angle detected by the angle sensor during each instance of the retry control. In addition, the predetermined intervals x need not always be constant, and may be set so as to increase or decrease in increments.

Although the present embodiment describes a configuration in which the restriction mechanism 50 is disposed on the retarded-side of the lock mechanism 60, the restriction mechanism 50 may be disposed on the advanced-side. In this case, the locked state can be achieved when the engine is stopped in the same manner as described in the present embodiment by replacing "advanced" with "retarded".

Other Embodiments

In the aforementioned embodiment, the configuration is such that the minimum cross-sectional area of the advanced passage 43 formed in the inner rotor 3 of the valve timing control device 1 is greater than the minimum cross-sectional area of the retarded passage 44, in order to rapidly insert the restriction member 5 into the restriction recess 52. However, instead of this configuration, the configuration may be such that the minimum cross-sectional area of the advanced connection path 45 is greater than the minimum cross-sectional area of the retarded connection path 46 between the valve timing control device 1 and the advanced/retarded control valve 72.

INDUSTRIAL APPLICABILITY

The present invention can be applied in valve timing control devices and valve timing control mechanisms that control the relative rotational phase of a driven-side rotating member relative to a driving-side rotating member that rotates in synchronization with a crankshaft in an internal combustion engine.

REFERENCE SIGNS LIST

1 valve timing control device
2 outer rotor (driving-side rotating member)
3 inner rotor (driven-side rotating member)
4 fluid pressure chamber
5 restriction member
6 lock member
9 cam shaft
11 crankshaft
12 engine (internal combustion engine)
31 partition portion
41 advanced angle chamber
42 retarded angle chamber
43 advanced passage (flow path for supplying fluid to advanced angle chamber)
44 retarded passage (flow path for supplying fluid to retarded angle chamber)
45 advanced connection path (flow channel between advanced/retarded control valve and advanced angle chamber)
46 retarded connection path (flow channel between advanced/retarded control valve and retarded angle chamber)
52 restriction recess
62 locking recess

72 advanced/retarded control valve
86 drain flow path
89 communication flow path
100 valve timing control mechanism

The invention claimed is:

1. A valve timing control device comprising:

a driving-side rotating member that rotates in synchronization with a crankshaft of an internal combustion engine;

a driven-side rotating member, disposed coaxially with the driving-side rotating member, that rotates in synchronization with a cam shaft for opening and closing a valve of the internal combustion engine;

a fluid pressure chamber formed by the driving-side rotating member and the driven-side rotating member;

a partition portion provided in at least one of the driving-side rotating member and the driven-side rotating member so as to partition the fluid pressure chamber into an advanced angle chamber and a retarded angle chamber;

a restriction member that is disposed in one of the driving-side rotating member and the driven-side rotating member and that is capable of extending/retracting into/from the other of the rotating members;

a restriction recess, formed in the other of the rotating members, into which the restriction member is inserted and that restricts a relative rotational phase of the driven-side rotating member relative to the driving-side rotating member to a range from one of a maximum advanced phase and a maximum retarded phase to a predetermined phase between the maximum advanced phase and the maximum retarded phase;

a lock member that is disposed in the one rotating member in which the restriction member is provided and that is capable of extending/retracting into/from the other of the rotating members;

a locking recess, formed in the other of the rotating members, into which the lock member is inserted and that locks the relative rotational phase of the driven-side rotating member relative to the driving-side rotating member in the predetermined phase; and a communication flow path formed between the restriction member and the lock member, wherein the device can switch between:

a first state in which a fluid is supplied to the communication flow path, the restriction by the restriction member is lifted, and the locking by the lock member is released;

a second state in which the fluid is supplied to one of the advanced angle chamber and the retarded angle chamber, the locking by the lock member is released, and the restriction member sets the restriction; and a third state in which the fluid is not supplied to the communication flow path and is not supplied to the one of the advanced angle chamber and the retarded angle chamber, the restriction member sets the restriction, and the lock member carries out locking, and wherein a minimum cross-sectional area of a flow path that supplies the fluid to the advanced angle chamber is configured to be greater than a minimum cross-sectional area of a flow path that supplies the fluid to the retarded angle chamber.

2. The valve timing control device according to claim 1, wherein the fluid is supplied to the communication flow path by communicating with the advanced angle chamber.

3. The valve timing control device according to claim 1, wherein a plurality of the partition portions are provided in the driven-side rotating member; and the lock member and the restriction member are both provided in one of the plurality of the partition portions.

4. The valve timing control device according to claim 1, wherein a drain flow path that communicates with the exterior of the driving-side rotating member is provided in at least the rotating member in which, of the driving-side rotating member and the driven-side rotating member, the restriction member is provided, and the drain flow path communicates with the restriction recess.

5. The valve timing control device according to claim 4, wherein when the relative rotational phase is within one of a phase range that excludes a range from the maximum advanced phase including the maximum advanced phase to the predetermined phase and a phase range that excludes a range from the maximum retarded phase including the maximum retarded phase to the predetermined phase, and the relative rotational phase is within a phase range where the restriction member can extend/retract from/into the restriction recess, the drain flow path is blocked from communicating with the exterior of the driving-side rotating member.

6. A valve timing control mechanism comprising:

a driving-side rotating member that rotates in synchronization with a crankshaft of an internal combustion engine;

a driven-side rotating member, disposed coaxially with the driving-side rotating member, that rotates in synchronization with a cam shaft for opening and closing a valve of the internal combustion engine;

a fluid pressure chamber formed by the driving-side rotating member and the driven-side rotating member;

a partition portion provided in at least one of the driving-side rotating member and the driven-side rotating member so as to partition the fluid pressure chamber into an advanced angle chamber and a retarded angle chamber;

a restriction member that is disposed in one of the driving-side rotating member and the driven-side rotating member and that is capable of extending/retracting into/from the other of the rotating members;

a restriction recess, formed in the other of the rotating members, into which the restriction member is inserted and that restricts a relative rotational phase of the driven-side rotating member relative to the driving-side rotating member to a range from one of a maximum advanced phase and a maximum retarded phase to a predetermined phase between the maximum advanced phase and the maximum retarded phase;

a lock member that is disposed in the one rotating member in which the restriction member is provided and that is capable of extending/retracting into/from the other of the rotating members;

a locking recess, formed in the other of the rotating members, into which the lock member is inserted and that locks the relative rotational phase of the driven-side rotating member relative to the driving-side rotating member in the predetermined phase;

a communication flow path formed between the restriction member and the lock member; and an advanced/retarded control valve that switches a supply of fluid to one of the advanced angle chamber and the retarded angle chamber, wherein the mechanism can switch between:

a first state in which a fluid is supplied to the communication flow path, the restriction by the restriction member is lifted, and the locking by the lock member is released;

a second state in which the fluid is supplied to one of the advanced angle chamber and the retarded angle chamber, the locking by the lock member is released, and the restriction member sets the restriction; and a third state in which the fluid is not supplied to the communication flow path and is not supplied to the one of the advanced angle chamber and the retarded angle chamber, the restriction member sets the restriction, and the lock member carries out locking, and wherein a minimum cross-sectional area of a flow path between the advanced/retarded control valve and the advanced angle chamber is configured to be greater than a minimum cross-sectional area of a flow path between the advanced/retarded control valve and the retarded angle chamber.

7. The valve timing control mechanism according to claim 6, wherein the fluid is supplied to the communication flow path by communicating with the advanced angle chamber.

8. The valve timing control mechanism according to claim 6, wherein a plurality of the partition portions are provided in the driven-side rotating member; and the lock member and the restriction member are both provided in one of the plurality of the partition portions.

9. The valve timing control mechanism according to claim 6, wherein a drain flow path that communicates with the exterior of the driving-side rotating member is provided in at least the rotating member in which, of the driving-side rotating member and the driven-side rotating member, the restriction member is provided, and the drain flow path communicates with the restriction recess.

10. The valve timing control mechanism according to claim 9, wherein when the relative rotational phase is within one of a phase range that excludes a range from the maximum advanced phase including the maximum advanced phase to the predetermined phase and a phase range that excludes a range from the maximum retarded phase including the maximum retarded phase to the predetermined phase, and the relative rotational phase is within a phase range where the restriction member can extend/retract from/into the restriction recess, the drain flow path is blocked from communicating with the exterior of the driving-side rotating member.

* * * * *